US009752460B2

(12) United States Patent
Bowan

(10) Patent No.: US 9,752,460 B2
(45) Date of Patent: Sep. 5, 2017

(54) PROCESS FOR CONTROLLING A POWER TURBINE THROTTLE VALVE DURING A SUPERCRITICAL CARBON DIOXIDE RANKINE CYCLE

(71) Applicant: Echogen Power Systems, LLC, Akron, OH (US)

(72) Inventor: Brett A. Bowan, Copley, OH (US)

(73) Assignee: Echogen Power Systems, LLC, Akron, OH (US)

( * ) Notice: Subject to any disclaimer, the term of this patent is extended or adjusted under 35 U.S.C. 154(b) by 331 days.

(21) Appl. No.: 14/164,780

(22) Filed: Jan. 27, 2014

(65) Prior Publication Data

US 2014/0208751 A1 Jul. 31, 2014

Related U.S. Application Data

(60) Provisional application No. 61/757,590, filed on Jan. 28, 2013.

(51) Int. Cl.
*F01K 7/16* (2006.01)
*F01K 7/32* (2006.01)
(Continued)

(52) U.S. Cl.
CPC ..... *F01K 7/165* (2013.01); *F01D 13/02* (2013.01); *F01D 17/00* (2013.01); *F01D 17/04* (2013.01);
(Continued)

(58) Field of Classification Search
CPC ..... F01D 19/00–19/02; F01D 21/00–21/20; F01D 17/00–17/085; F01K 13/02; F01K 25/103; F01K 7/165; F01K 7/32
See application file for complete search history.

(56) References Cited

U.S. PATENT DOCUMENTS 1,969,526 A * 8/1934 Rosch ..... H02P 9/00 290/2
2,575,478 A 11/1951 Wilson
(Continued)

FOREIGN PATENT DOCUMENTS

CA 2794150 A1 11/2011
CN 1165238 A 11/1997
(Continued)

OTHER PUBLICATIONS

Alpy, N., et al., "French Atomic Energy Commission views as regards to SCO2 Cycle Development priorities and related R&D approach", Presentation, Symposium on SCO2 Power Cycles, Apr. 29-30, 2009, Troy, NY, 20 pages.
(Continued)

*Primary Examiner* — Mark Laurenzi
*Assistant Examiner* — Wesley Harris
(74) *Attorney, Agent, or Firm* — Nolte Intellectual Property Law Group

(57) ABSTRACT

Embodiments of the invention generally provide a heat engine system, a method for generating electricity, and an algorithm for controlling the heat engine system which are configured to efficiently transform thermal energy of a waste heat stream into electricity. In one embodiment, the heat engine system utilizes a working fluid (e.g., sc-$CO_2$) within a working fluid circuit for absorbing the thermal energy that is transformed to mechanical energy by a turbine and electrical energy by a generator. The heat engine system further contains a control system operatively connected to the working fluid circuit and enabled to monitor and control parameters of the heat engine system by manipulating a power turbine throttle valve to adjust the flow of the working fluid. A control algorithm containing multiple system controllers may be utilized by the control system to adjust the
(Continued)

power turbine throttle valve while maximizing efficiency of the heat engine system.

9 Claims, 4 Drawing Sheets

(51) Int. Cl.

| | |
|---|---|
| ***F01D 21/14*** | (2006.01) |
| ***F01D 19/02*** | (2006.01) |
| ***F01D 19/00*** | (2006.01) |
| ***F01D 21/00*** | (2006.01) |
| ***F01D 13/02*** | (2006.01) |
| ***F01D 17/04*** | (2006.01) |
| ***F01D 17/00*** | (2006.01) |
| ***F01K 13/02*** | (2006.01) |
| ***F01K 25/10*** | (2006.01) |

(52) U.S. Cl.
CPC ..... *F01D 19/00* (2013.01); *F01D 19/02* (2013.01); *F01D 21/00* (2013.01); *F01D 21/14* (2013.01); *F01K 7/32* (2013.01); *F01K 13/02* (2013.01); *F01K 25/103* (2013.01)

(56) References Cited

U.S. PATENT DOCUMENTS 2,634,375 A 4/1953 Guimbal
2,691,280 A 10/1954 Albert
3,095,274 A 6/1963 Crawford
3,105,748 A 10/1963 Stahl
3,237,403 A 3/1966 Feher
3,277,955 A 10/1966 Laszlo
3,401,277 A 9/1968 Larson
3,622,767 A 11/1971 Koepcke
3,630,022 A 12/1971 Jubb
3,736,745 A 6/1973 Karig
3,772,879 A 11/1973 Engdahl
3,791,137 A 2/1974 Jubb
3,830,062 A 8/1974 Morgan et al.
3,939,328 A 2/1976 Davis
3,971,211 A 7/1976 Wethe
3,982,379 A 9/1976 Gilli
3,998,058 A 12/1976 Park
4,009,575 A 3/1977 Hartman, Jr.
4,029,255 A 6/1977 Heiser
4,030,312 A 6/1977 Wallin
4,049,407 A 9/1977 Bottum
4,070,870 A 1/1978 Bahel
4,071,897 A * 1/1978 Groves, Jr. ..... F01D 21/02 290/40 A
4,099,381 A 7/1978 Rappoport
4,119,140 A 10/1978 Cates
4,150,547 A 4/1979 Hobson
4,152,901 A 5/1979 Munters
4,164,848 A 8/1979 Gilli
4,164,849 A 8/1979 Mangus
4,170,435 A 10/1979 Swearingen
4,178,762 A * 12/1979 Binstock ..... F01D 17/18 60/660
4,182,960 A 1/1980 Reuyl
4,183,220 A 1/1980 Shaw
4,198,827 A 4/1980 Terry et al.
4,208,882 A 6/1980 Lopes
4,221,185 A 9/1980 Scholes
4,233,085 A 11/1980 Roderick
4,236,869 A 12/1980 Laurello
4,248,049 A 2/1981 Briley
4,257,232 A 3/1981 Bell
4,287,430 A 9/1981 Guido
4,336,692 A 6/1982 Ecker
4,347,711 A 9/1982 Noe
4,347,714 A 9/1982 Kinsell
4,372,125 A 2/1983 Dickenson
4,384,568 A 5/1983 Palmatier
4,391,101 A 7/1983 Labbe
4,420,947 A 12/1983 Yoshino
4,428,190 A 1/1984 Bronicki
4,433,554 A 2/1984 Rojey
4,439,687 A 3/1984 Wood
4,439,994 A 4/1984 Briley
4,448,033 A 5/1984 Briccetti
4,450,363 A 5/1984 Russell
4,455,836 A 6/1984 Binstock
4,467,609 A 8/1984 Loomis
4,467,621 A 8/1984 O'Brien
4,475,353 A 10/1984 Lazare
4,489,562 A 12/1984 Snyder
4,489,563 A 12/1984 Kalina
4,498,289 A 2/1985 Osgerby
4,516,403 A 5/1985 Tanaka
4,538,960 A 9/1985 Iino et al.
4,549,401 A 10/1985 Spliethoff
4,555,905 A 12/1985 Endou
4,558,228 A 12/1985 Larjola
4,573,321 A 3/1986 Knaebel
4,578,953 A 4/1986 Krieger
4,589,255 A 5/1986 Martens
4,636,578 A 1/1987 Feinberg
4,674,297 A 6/1987 Vobach
4,694,189 A 9/1987 Haraguchi
4,697,981 A 10/1987 Brown et al.
4,700,543 A 10/1987 Krieger
4,730,977 A 3/1988 Haaser
4,756,162 A 7/1988 Dayan
4,765,143 A 8/1988 Crawford
4,773,212 A 9/1988 Griffin
4,798,056 A 1/1989 Franklin
4,813,242 A 3/1989 Wicks
4,821,514 A 4/1989 Schmidt
4,867,633 A 9/1989 Gravelle
4,888,954 A * 12/1989 Silvestri, Jr. ..... F01K 7/165 60/652
4,892,459 A 1/1990 Guelich
4,986,071 A 1/1991 Voss
4,993,483 A 2/1991 Harris
5,000,003 A 3/1991 Wicks
5,050,375 A 9/1991 Dickinson
5,083,425 A 1/1992 Hendriks et al.
5,098,194 A 3/1992 Kuo
5,102,295 A 4/1992 Pope
5,104,284 A 4/1992 Hustak, Jr.
5,164,020 A 11/1992 Wagner
5,176,321 A 1/1993 Doherty
5,203,159 A 4/1993 Koizumi et al.
5,228,310 A 7/1993 Vandenberg
5,291,960 A 3/1994 Brandenburg
5,320,482 A 6/1994 Palmer et al.
5,335,510 A 8/1994 Rockenfeller
5,358,378 A 10/1994 Holscher
5,360,057 A 11/1994 Rockenfeller
5,392,606 A 2/1995 Labinov
5,440,882 A 8/1995 Kalina
5,444,972 A 8/1995 Moore
5,483,797 A 1/1996 Rigal et al.
5,488,828 A 2/1996 Brossard
5,490,386 A 2/1996 Keller
5,503,222 A 4/1996 Dunne
5,531,073 A 7/1996 Bronicki
5,538,564 A 7/1996 Kaschmitter
5,542,203 A 8/1996 Luoma
5,570,578 A 11/1996 Saujet
5,588,298 A 12/1996 Kalina
5,600,967 A 2/1997 Meckler
5,609,465 A * 3/1997 Batson ..... F01D 17/06 415/1
5,634,340 A 6/1997 Grennan
5,647,221 A 7/1997 Garris, Jr.
5,649,426 A 7/1997 Kalina
5,676,382 A 10/1997 Dahlheimer
5,680,753 A 10/1997 Hollinger
5,738,164 A 4/1998 Hildebrand
5,754,613 A 5/1998 Hashiguchi

(56) References Cited

U.S. PATENT DOCUMENTS 5,771,700 A 6/1998 Cochran
5,789,822 A 8/1998 Calistrat
5,813,215 A 9/1998 Weisser
5,833,876 A 11/1998 Schnur
5,862,666 A 1/1999 Liu
5,873,260 A 2/1999 Linhardt
5,874,039 A 2/1999 Edelson
5,894,836 A 4/1999 Wu
5,899,067 A 5/1999 Hageman
5,903,060 A 5/1999 Norton
5,918,460 A 7/1999 Connell
5,941,238 A 8/1999 Tracy
5,943,869 A 8/1999 Cheng
5,946,931 A 9/1999 Lomax
5,973,050 A 10/1999 Johnson
6,037,683 A 3/2000 Lulay
6,041,604 A 3/2000 Nicodemus
6,058,930 A 5/2000 Shingleton
6,062,815 A 5/2000 Holt
6,065,280 A 5/2000 Ranasinghe
6,066,797 A 5/2000 Toyomura
6,070,405 A 6/2000 Jerye
6,082,110 A 7/2000 Rosenblatt
6,105,368 A 8/2000 Hansen
6,112,547 A 9/2000 Spauschus
6,129,507 A 10/2000 Ganelin
6,158,237 A 12/2000 Riffat
6,164,655 A 12/2000 Bothien
6,202,782 B1 3/2001 Hatanaka
6,223,846 B1 5/2001 Schechter
6,233,938 B1 5/2001 Nicodemus
6,282,900 B1 9/2001 Bell
6,282,917 B1 9/2001 Mongan
6,295,818 B1 10/2001 Ansley
6,299,690 B1 10/2001 Mongeon
6,341,781 B1 1/2002 Matz
6,347,520 B1 * 2/2002 Ranasinghe ..... F01K 25/065 60/39.182
6,374,630 B1 4/2002 Jones
6,393,851 B1 5/2002 Wightman
6,432,320 B1 8/2002 Bonsignore
6,434,955 B1 8/2002 Ng
6,442,951 B1 9/2002 Maeda
6,446,425 B1 9/2002 Lawlor
6,446,465 B1 9/2002 Dubar
6,463,730 B1 10/2002 Keller
6,484,490 B1 11/2002 Olsen
6,539,720 B2 4/2003 Rouse et al.
6,539,728 B2 4/2003 Korin
6,571,548 B1 6/2003 Bronicki
6,581,384 B1 6/2003 Benson
6,598,397 B2 7/2003 Hanna
6,644,062 B1 11/2003 Hays
6,657,849 B1 12/2003 Andresakis
6,668,554 B1 12/2003 Brown
6,684,625 B2 2/2004 Kline
6,695,974 B2 2/2004 Withers
6,715,294 B2 4/2004 Anderson
6,734,585 B2 5/2004 Tornquist
6,735,948 B1 5/2004 Kalina
6,739,142 B2 5/2004 Korin
6,751,959 B1 6/2004 McClanahan et al.
6,769,256 B1 8/2004 Kalina
6,799,892 B2 10/2004 Leuthold
6,808,179 B1 10/2004 Bhattacharyya
6,810,335 B2 10/2004 Lysaght
6,817,185 B2 11/2004 Coney
6,857,268 B2 2/2005 Stinger
6,910,334 B2 6/2005 Kalina
6,918,254 B2 7/2005 Baker
6,921,518 B2 7/2005 Johnston
6,941,757 B2 9/2005 Kalina
6,960,839 B2 11/2005 Zimron
6,960,840 B2 11/2005 Willis
6,962,054 B1 11/2005 Linney
6,964,168 B1 11/2005 Pierson
6,968,690 B2 11/2005 Kalina
6,986,251 B2 1/2006 Radcliff
7,013,205 B1 3/2006 Hafner et al.
7,021,060 B1 4/2006 Kalina
7,022,294 B2 4/2006 Johnston
7,033,553 B2 4/2006 Johnston et al.
7,036,315 B2 5/2006 Kang
7,041,272 B2 5/2006 Keefer
7,047,744 B1 5/2006 Robertson
7,048,782 B1 5/2006 Couch
7,062,913 B2 6/2006 Christensen
7,096,665 B2 8/2006 Stinger
7,096,679 B2 8/2006 Manole
7,124,587 B1 10/2006 Linney
7,174,715 B2 2/2007 Armitage
7,194,863 B2 3/2007 Ganev
7,197,876 B1 4/2007 Kalina
7,200,996 B2 4/2007 Cogswell
7,234,314 B1 6/2007 Wiggs
7,249,588 B2 7/2007 Russell
7,278,267 B2 10/2007 Yamada
7,279,800 B2 10/2007 Bassett
7,287,381 B1 10/2007 Pierson
7,305,829 B2 12/2007 Mirolli
7,313,926 B2 1/2008 Gurin
7,340,894 B2 3/2008 Miyahara et al.
7,340,897 B2 3/2008 Zimron
7,406,830 B2 8/2008 Valentian
7,416,137 B2 8/2008 Hagen et al.
7,453,242 B2 11/2008 Ichinose
7,458,217 B2 12/2008 Kalina
7,458,218 B2 12/2008 Kalina
7,464,551 B2 12/2008 Althaus et al.
7,469,542 B2 12/2008 Kalina
7,516,619 B2 4/2009 Pelletier
7,600,394 B2 10/2009 Kalina
7,621,133 B2 11/2009 Tomlinson
7,654,354 B1 2/2010 Otterstrom
7,665,291 B2 2/2010 Anand
7,665,304 B2 2/2010 Sundel
7,685,821 B2 3/2010 Kalina
7,730,713 B2 6/2010 Nakano
7,735,335 B2 6/2010 Uno
7,770,376 B1 8/2010 Brostmeyer
7,775,758 B2 8/2010 Legare
7,827,791 B2 11/2010 Pierson
7,838,470 B2 11/2010 Shaw
7,841,179 B2 11/2010 Kalina
7,841,306 B2 11/2010 Myers
7,854,587 B2 12/2010 Ito
7,866,157 B2 1/2011 Ernst
7,900,450 B2 3/2011 Gurin
7,950,230 B2 5/2011 Nishikawa
7,950,243 B2 5/2011 Gurin
7,972,529 B2 7/2011 Machado
7,997,076 B2 8/2011 Ernst
8,096,128 B2 1/2012 Held et al.
8,099,198 B2 1/2012 Gurin
8,146,360 B2 4/2012 Myers
8,281,593 B2 10/2012 Held
8,419,936 B2 4/2013 Berger et al.
8,833,077 B2 * 9/2014 Kalina ..... F01K 25/06 60/649
2001/0015061 A1 8/2001 Viteri et al.
2001/0020444 A1 9/2001 Johnston
2001/0030952 A1 10/2001 Roy
2002/0029558 A1 3/2002 Tamaro
2002/0066270 A1 6/2002 Rouse et al.
2002/0078696 A1 6/2002 Korin
2002/0078697 A1 6/2002 Lifson
2002/0082747 A1 6/2002 Kramer
2003/0000213 A1 1/2003 Christensen
2003/0061823 A1 4/2003 Alden
2003/0154718 A1 8/2003 Nayar
2003/0182946 A1 10/2003 Sami
2003/0213246 A1 11/2003 Coll et al.
2003/0221438 A1 12/2003 Rane et al.
2004/0011038 A1 1/2004 Stinger

(56) References Cited

U.S. PATENT DOCUMENTS

2004/0011039 A1 1/2004 Stinger et al.
2004/0020185 A1 2/2004 Brouillette et al.
2004/0020206 A1 2/2004 Sullivan et al.
2004/0021182 A1 2/2004 Green et al.
2004/0035117 A1 2/2004 Rosen
2004/0083731 A1 5/2004 Lasker
2004/0083732 A1 5/2004 Hanna et al.
2004/0088992 A1 5/2004 Brasz et al.
2004/0097388 A1 5/2004 Brask et al.
2004/0105980 A1 6/2004 Sudarshan et al.
2004/0107700 A1 6/2004 McClanahan et al.
2004/0159110 A1 8/2004 Janssen
2004/0211182 A1 10/2004 Gould
2005/0022963 A1 2/2005 Garrabrant et al.
2005/0056001 A1 3/2005 Frutschi
2005/0096676 A1 5/2005 Gifford et al.
2005/0109387 A1 5/2005 Marshall
2005/0137777 A1 6/2005 Kolavennu et al.
2005/0162018 A1 7/2005 Realmuto et al.
2005/0167169 A1 8/2005 Gering et al.
2005/0183421 A1 8/2005 Vaynberg et al.
2005/0196676 A1 9/2005 Singh et al.
2005/0198959 A1 9/2005 Schubert
2005/0227187 A1 10/2005 Schilling
2005/0252235 A1 11/2005 Critoph et al.
2005/0257812 A1 11/2005 Wright et al.
2006/0010868 A1* 1/2006 Smith ..... F01K 25/06 60/645
2006/0060333 A1 3/2006 Chordia et al.
2006/0066113 A1 3/2006 Ebrahim et al.
2006/0080960 A1 4/2006 Rajendran et al.
2006/0112693 A1 6/2006 Sundel
2006/0182680 A1 8/2006 Keefer et al.
2006/0211871 A1 9/2006 Dai et al.
2006/0213218 A1 9/2006 Uno et al.
2006/0225421 A1 10/2006 Yamanaka et al.
2006/0225459 A1 10/2006 Meyer
2006/0249020 A1 11/2006 Tonkovich et al.
2006/0254281 A1 11/2006 Badeer et al.
2007/0001766 A1 1/2007 Ripley et al.
2007/0017192 A1 1/2007 Bednarek et al.
2007/0019708 A1 1/2007 Shiflett et al.
2007/0027038 A1 2/2007 Kamimura et al.
2007/0056290 A1 3/2007 Dahm
2007/0089449 A1 4/2007 Gurin
2007/0108200 A1 5/2007 McKinzie, II
2007/0119175 A1 5/2007 Ruggieri et al.
2007/0130952 A1 6/2007 Copen
2007/0151244 A1 7/2007 Gurin
2007/0161095 A1 7/2007 Gurin
2007/0163261 A1 7/2007 Strathman
2007/0195152 A1 8/2007 Kawai et al.
2007/0204620 A1 9/2007 Pronske et al.
2007/0227472 A1 10/2007 Takeuchi et al.
2007/0234722 A1 10/2007 Kalina
2007/0245733 A1 10/2007 Pierson et al.
2007/0246206 A1 10/2007 Gong et al.
2008/0000225 A1 1/2008 Kalina
2008/0006040 A1 1/2008 Peterson et al.
2008/0010967 A1 1/2008 Griffin et al.
2008/0023666 A1 1/2008 Gurin
2008/0053095 A1 3/2008 Kalina
2008/0066470 A1 3/2008 MacKnight
2008/0135253 A1 6/2008 Vinegar et al.
2008/0163625 A1 7/2008 O'Brien
2008/0173450 A1 7/2008 Goldberg et al.
2008/0211230 A1 9/2008 Gurin
2008/0250789 A1 10/2008 Myers et al.
2008/0252078 A1 10/2008 Myers
2009/0021251 A1 1/2009 Simon
2009/0085709 A1 4/2009 Meinke
2009/0107144 A1 4/2009 Moghtaderi et al.
2009/0139234 A1 6/2009 Gurin
2009/0139781 A1 6/2009 Straubel
2009/0173337 A1 7/2009 Tamaura et al.
2009/0173486 A1 7/2009 Copeland
2009/0180903 A1 7/2009 Martin et al.
2009/0205892 A1 8/2009 Jensen et al.
2009/0211251 A1 8/2009 Petersen et al.
2009/0211253 A1 8/2009 Radcliff et al.
2009/0266075 A1 10/2009 Westmeier et al.
2009/0293503 A1 12/2009 Vandor
2010/0024421 A1 2/2010 Litwin
2010/0077792 A1 4/2010 Gurin
2010/0083662 A1 4/2010 Kalina
2010/0102008 A1 4/2010 Hedberg
2010/0122533 A1 5/2010 Kalina
2010/0146949 A1 6/2010 Stobart et al.
2010/0146973 A1 6/2010 Kalina
2010/0156112 A1* 6/2010 Held ..... F01K 3/185 290/1 A
2010/0162721 A1 7/2010 Welch et al.
2010/0205962 A1 8/2010 Kalina
2010/0218513 A1 9/2010 Vaisman et al.
2010/0218930 A1 9/2010 Proeschel
2010/0263380 A1 10/2010 Biederman et al.
2010/0287934 A1 11/2010 Glynn et al.
2010/0300093 A1 12/2010 Doty
2010/0326076 A1 12/2010 Ast et al.
2011/0027064 A1 2/2011 Pal et al.
2011/0030404 A1 2/2011 Gurin
2011/0048012 A1 3/2011 Ernst et al.
2011/0061384 A1 3/2011 Held et al.
2011/0061387 A1 3/2011 Held et al.
2011/0088399 A1 4/2011 Briesch et al.
2011/0179799 A1 7/2011 Allam et al.
2011/0185729 A1 8/2011 Held
2011/0192163 A1 8/2011 Kasuya
2011/0203278 A1 8/2011 Kopecek et al.
2011/0259010 A1 10/2011 Bronicki et al.
2011/0299972 A1 12/2011 Morris
2011/0308253 A1 12/2011 Ritter
2012/0047892 A1 3/2012 Held et al.
2012/0067055 A1 3/2012 Held
2012/0128463 A1 5/2012 Held
2012/0131918 A1 5/2012 Held
2012/0131919 A1 5/2012 Held
2012/0131920 A1 5/2012 Held
2012/0131921 A1 5/2012 Held
2012/0159922 A1 6/2012 Gurin
2012/0159956 A1 6/2012 Gurin
2012/0174558 A1 7/2012 Gurin
2012/0186219 A1 7/2012 Gurin
2012/0247134 A1 10/2012 Gurin
2012/0247455 A1 10/2012 Gurin et al.
2012/0261090 A1 10/2012 Durmaz et al.
2013/0019597 A1 1/2013 Kalina
2013/0033037 A1 2/2013 Held et al.
2013/0036736 A1 2/2013 Hart et al.
2013/0113221 A1 5/2013 Held

FOREIGN PATENT DOCUMENTS

CN 1432102 A 7/2003
CN 101614139 A 12/2009
CN 202055876 U 11/2011
CN 202544943 U 11/2012
CN 202718721 U 2/2013
DE 2632777 A1 2/1977
DE 19906087 A1 8/2000
DE 10052993 A1 5/2002
EP 1977174 A2 10/2008
EP 1998013 A2 12/2008
EP 2419621 A1 2/2012
EP 2446122 A1 5/2012
EP 2478201 A1 7/2012
EP 2500530 A1 9/2012
EP 2550436 A1 1/2013
GB 856985 A 12/1960
GB 2010974 A 7/1979
GB 2075608 A 11/1981
JP 58-193051 A 11/1983
JP 60-040707 A 3/1985
JP 61-152914 A 7/1986

(56) References Cited

FOREIGN PATENT DOCUMENTS

| | | | |
|---|---|---|---|
| JP | 01-240705 | A | 9/1989 |
| JP | 05-321612 | A | 12/1993 |
| JP | 06-331225 | A | 11/1994 |
| JP | 08-028805 | A | 2/1996 |
| JP | 09-100702 | A | 4/1997 |
| JP | 2641581 | B2 | 5/1997 |
| JP | 09-209716 | A | 8/1997 |
| JP | 2858750 | B2 | 12/1998 |
| JP | H11-270352 | | 5/1999 |
| JP | 2000-257407 | A | 9/2000 |
| JP | 2001-193419 | A | 7/2001 |
| JP | 2002-097965 | A | 4/2002 |
| JP | 2003-529715 | A | 10/2003 |
| JP | 2004-239250 | A | 8/2004 |
| JP | 2004-332626 | A | 11/2004 |
| JP | 2005-030727 | A | 2/2005 |
| JP | 2005-533972 | A1 | 11/2005 |
| JP | 2006-037760 | A | 2/2006 |
| JP | 2006-177266 | A | 7/2006 |
| JP | 2007-198200 | A | 9/2007 |
| JP | 4343738 | B2 | 10/2009 |
| JP | 2011-017268 | A | 1/2011 |
| KR | 10-0191080 | | 6/1999 |
| KR | 10-20070086244 | A | 8/2007 |
| KR | 10-0766101 | B1 | 10/2007 |
| KR | 10-0844634 | A | 7/2008 |
| KR | 10-20100067927 | A | 6/2010 |
| KR | 10-20110018769 | A | 2/2011 |
| KR | 1069914 | B1 | 9/2011 |
| KR | 1103549 | B1 | 1/2012 |
| KR | 10-20120058582 | A | 6/2012 |
| KR | 2012-0068670 | A | 6/2012 |
| KR | 2012-0128753 | A | 11/2012 |
| KR | 2012-0128755 | A | 11/2012 |
| WO | 91-05145 | A1 | 4/1991 |
| WO | 96-09500 | A1 | 3/1996 |
| WO | 00-71944 | A1 | 11/2000 |
| WO | 01-44658 | A1 | 6/2001 |
| WO | 2006-060253 | A1 | 6/2006 |
| WO | 2006-137957 | A1 | 12/2006 |
| WO | 2007-056241 | A2 | 5/2007 |
| WO | 2007-079245 | A2 | 7/2007 |
| WO | 2007-082103 | A2 | 7/2007 |
| WO | 2007-112090 | A2 | 10/2007 |
| WO | 2008-039725 | A2 | 4/2008 |
| WO | 2008-101711 | A2 | 8/2008 |
| WO | 2009-045196 | A1 | 4/2009 |
| WO | 2009-058992 | A2 | 5/2009 |
| WO | 2010-074173 | A1 | 7/2010 |
| WO | 2010-083198 | A1 | 7/2010 |
| WO | 2010-121255 | A1 | 10/2010 |
| WO | 2010-126980 | A2 | 11/2010 |
| WO | 2010-151560 | A1 | 12/2010 |
| WO | 2011-017450 | A2 | 2/2011 |
| WO | 2011-017476 | A1 | 2/2011 |
| WO | 2011-017599 | A1 | 2/2011 |
| WO | 2011-034984 | A1 | 3/2011 |
| WO | 2011-094294 | A2 | 8/2011 |
| WO | 2011-119650 | A2 | 9/2011 |
| WO | 2012-074905 | A2 | 6/2012 |
| WO | 2012-074907 | A2 | 6/2012 |
| WO | 2012-074911 | A2 | 6/2012 |
| WO | 2012-074940 | A2 | 6/2012 |
| WO | 2013-055391 | A1 | 4/2013 |
| WO | 2013-059687 | A1 | 4/2013 |
| WO | 2013-059695 | A1 | 4/2013 |
| WO | 2013-070249 | A1 | 5/2013 |
| WO | 2013-074907 | A1 | 5/2013 |

OTHER PUBLICATIONS

Angelino, G. and Invernizzi, C.M., "Carbon Dioxide Power Cycles using Liquid Natural Gas as Heat Sink", Applied Thermal Engineering, Mar. 3, 2009, 43 pages.

Bryant, John C., Saari, Henry, and Zanganeh, Kourosh, "An Analysis and Comparison of the Simple and Recompression Supercritical CO2 Cycles", Supercritical CO2 Power Cycle Symposium, May 24-25, 2011, Boulder, CO, 8 pages.

Chapman, Daniel J., Arias, Diego A., "An Assessment of the Supercritical Carbon Dioxide Cycle for Use in a Solar Parabolic Trough Power Plant", Presentation, Abengoa Solar, Apr. 29-30, 2009, Troy, NY, 20 pages.

Chapman, Daniel J., Arias, Diego A., "An Assessment of the Supercritical Carbon Dioxide Cycle for Use in a Solar Parabolic Trough Power Plant", Paper, Abengoa Solar, Apr. 29-30, 2009, Troy, NY, 5 pages.

Chen, Yang, Lundqvist, P., Johansson, A., Platell, P., "A Comparative Study of the Carbon Dioxide Transcritical Power Cycle Compared with an Organic Rankine Cycle with R123 as Working Fluid in Waste Heat Recovery", Science Direct, Applied Thermal Engineering, Jun. 12, 2006, 6 pages.

Chen, Yang, "Thermodynamic Cycles Using Carbon Dioxide as Working Fluid", Doctoral Thesis, School of Industrial Engineering and Management, Stockholm, Oct. 2011, 150 pages, (3 parts).

Chinese Search Report for Application No. 201080035382.1, 2 pages.

Chinese Search Report for Application No. 201080050795.7, 2 pages.

Chordia, Lalit, "Optimizing Equipment for Supercritical Applications", Thar Energy LLC, Supercritical CO2 Power Cycle Symposium, May 24-25, 2011, Boulder, CO, 7 pages.

Combs, Osie V., "An Investigation of the Supercritical CO2 Cycle (Feher cycle) for Shipboard Application", Massachusetts Institute of Technology, May 1977, 290 pages.

Di Bella, Francis A., "A Gas Turbine Engine Exhaust Waste Heat Recovery Navy Shipboard Module Development", Supercritical CO2 Power Cycle Symposium, May 24-25, 2011, Boulder, CO, 8 pages.

Dostal, V., et al., "A Supercritical Carbon Dioxide Cycle for Next Generation Nuclear Reactors", Mar. 10, 2004, 326 pages, (7 parts).

Dostal, Vaclav and Kulhanek, Martin, "Research on the Supercritical Carbon Dioxide Cycles in the Czech Republic", Czech Technical University in Prague, Symposium on SCO2 Power Cycles, Apr. 29-30, Troy, NY, 8 pages.

Dostal, Vaclav, and Dostal, Jan, "Supercritical CO2 Regeneration Bypass Cycle—Comparison to Traditional Layouts", Supercritical CO2 Power Cycle Symposium, May 24-25, 2011, Boulder, CO, 5 pages.

Eisemann, Kevin, and Fuller, Robert L., "Supercritical CO2 Brayton Cycle Design and System Start-up Options", Barber Nichols, Inc., Paper, Supercritical CO2 Power Cycle Symposium, May 24-25, 2011, Boulder, CO, 7 pages.

Eisemann, Kevin, and Fuller, Robert L., "Supercritical CO2 Brayton Cycle Design and System Start-up Options", Presentation, Supercritical CO2 Power Cycle Symposium, May 24-25, 2011, Boulder, CO, 11 pages.

Feher, E.G., et al., "Investigation of Supercritical (Feher) Cycle", Astropower Laboratory, Missile & Space Systems Division, Oct. 1968, 152 pages.

Fuller, Robert L. and Eisemann, Kevin, "Centrifugal Compressor Off-Design Performance for Super-Critical CO2", Barber Nichols, Inc. Presentation, Supercritical CO2 Power Cycle Symposium, May 24-25, 2011, Boulder, CO, 20 pages.

Fuller, Robert L. and Eisemann, Kevin, "Centrifugal Compressor Off-Design Performance for Super-Critical CO2", Paper, Supercritical CO2 Power Cycle Symposium, May 24-25, 2011, Boulder, CO, 12 pages.

Gokhstein, D.P. and Verkhivker, G.P., "Use of Carbon Dioxide as a Heat Carrier and Working Substance in Atomic Power Stations", Soviet Atomic Energy, Apr. 1969, vol. 26, Issue 4, pp. 430-432.

Gokhstein, D.P., Taubman, E.I., Konyaeva, G.P., "Thermodynamic Cycles of Carbon Dioxide Plant with an Additional Turbine After the Regenerator", Energy Citations Database, Mar. 1973, 1 page, Abstract only.

Hejzlar, P., et al., "Assessment of Gas Cooled Gas Reactor with Indirect Supercritical CO2 Cycle", Massachusetts Institute of Technology, Jan. 2006, 10 pages.

(56) References Cited

OTHER PUBLICATIONS

Hoffman, John R. and Feher, E.G., "150 kwe Supercritical Closed Cycle System", Transactions of the ASME, Jan. 1971, pp. 70-80.
Jeong, Woo Seok, et al., "Performance of S-CO2 Brayton Cycle with Additive Gases for SFR Application", Korea Advanced Institute of Science and Technology, Supercritical CO2 Power Cycle Symposium, May 24-25, 2011, Boulder, CO, 5 pages.
Johnson, Gregory A. & McDowell, Michael, "Issues Associated with Coupling Supercritical CO2 Power Cycles to Nuclear, Solar and Fossil Fuel Heat Sources", Hamilton Sundstrand, Energy Space & Defense-Rocketdyne, Apr. 29-30, 2009, Troy, NY, Presentation, 18 pages.
Kawakubo, Tomoki, "Unsteady Roto-Stator Interaction of a Radial-Inflow Turbine with Variable Nozzle Vanes", ASME Turbo Expo 2010: Power for Land, Sea, and Air; vol. 7: Turbomachinery, Parts A, B, and C; Glasgow, UK, Jun. 14-18, 2010, Paper No. GT2010-23677, pp. 2075-2084, 1 page, (Abstract only).
Kulhanek, Martin, "Thermodynamic Analysis and Comparison of S-CO2 Cycles", Presentation, Czech Technical University in Prague, Supercritical CO2 Power Cycle Symposium, May 24-25, 2011, Boulder, CO, 14 pages.
Kulhanek, Martin, "Thermodynamic Analysis and Comparison of S-CO2 Cycles", Paper, Czech Technical University in Prague, Supercritical CO2 Power Cycle Symposium, May 24-25, 2011, Boulder, CO, 7 pages.
Kulhanek, Martin and Dostal, Vaclav, "Supercritical Carbon Dioxide Cycles Thermodynamic Analysis and Comparison", Abstract, Faculty Conference held in Prague, Mar. 24, 2009, 13 pages.
Ma, Zhiwen and Turchi, Craig S., "Advanced Supercritical Carbon Dioxide Power Cycle Configurations for Use in Concentrating Solar Power Systems", National Renewable Energy Laboratory, Supercritical CO2 Power Cycle Symposium, May 24-25, 2011, Boulder, CO, 4 pages.
Moisseytsev, Anton and Sienicki, Jim, "Investigation of Alternative Layouts for the Supercritical Carbon Dioxide Brayton Cycle for a Sodium-Cooled Fast Reactor", Supercritical CO2 Power Cycle Symposium, Troy, NY, Apr. 29, 2009, 26 pages.
Munoz De Escalona, Jose M., "The Potential of the Supercritical Carbon Dioxide Cycle in High Temperature Fuel Cell Hybrid Systems", Paper, Thermal Power Group, University of Seville, Supercritical CO2 Power Cycle Symposium, May 24-25, 2011, Boulder, CO, 6 pages.
Munoz De Escalona, Jose M., et al., "The Potential of the Supercritical Carbon Dioxide Cycle in High Temperature Fuel Cell Hybrid Systems", Presentation, Thermal Power Group, University of Seville, Supercritical CO2 Power Cycle Symposium, May 24-25, 2011, Boulder, CO, 19 pages.
Muto, Y., et al., "Application of Supercritical CO2 Gas Turbine for the Fossil Fired Thermal Plant", Journal of Energy and Power Engineering, Sep. 30, 2010, vol. 4, No. 9, 9 pages.
Muto, Yasushi and Kato, Yasuyoshi, "Optimal Cycle Scheme of Direct Cycle Supercritical CO2 Gas Turbine for Nuclear Power Generation Systems", International Conference on Power Engineering—2007, Oct. 23-27, 2007, Hangzhou, China, pp. 86-87.
Noriega, Bahamonde J.S., "Design Method for S-CO2 Gas Turbine Power Plants", Master of Science Thesis, Delft University of Technology, Oct. 2012, 122 pages, (3 parts).
Oh, Chang, et al., "Development of a Supercritical Carbon Dioxide Brayton Cycle: Improving PBR Efficiency and Testing Material Compatibility", Presentation, Nuclear Energy Research Initiative Report, Oct. 2004, 38 pages.
Oh, Chang, et al., "Development of a Supercritical Carbon Dioxide Brayton Cycle: Improving VHTR Efficiency and Testing Material Compatibility", Presentation, Nuclear Energy Research Initiative Report, Final Report, Mar. 2006, 97 pages.
Parma, Ed, et al., "Supercritical CO2 Direct Cycle Gas Fast Reactor (SC-GFR) Concept", Presentation for Supercritical CO2 Power Cycle Symposium, May 24-25, 2011, Boulder, CO, 40 pages.
Parma, Ed, et al., "Supercritical CO2 Direct Cycle Gas Fast Reactor (SC-GFR) Concept", Supercritical CO2 Power Cycle Symposium, May 24-25, 2011, Boulder, CO, 9 pages.
Parma, Edward J., et al., "Supercritical CO2 Direct Cycle Gas Fast Reactor (SC-GFR) Concept", Presentation, Sandia National Laboratories, May 2011, 55 pages.
PCT/US2006/049623—Written Opinion of ISA dated Jan. 4, 2008, 4 pages.
PCT/US2007/001120—International Search Report dated Apr. 25, 2008, 7 pages.
PCT/US2007/079318—International Preliminary Report on Patentability dated Jul. 7, 2008, 5 pages.
PCT/US2010/0131614—International Search Report dated Jul. 12, 2010, 3 pages.
PCT/US2010/031614—International Preliminary Report on Patentability dated Oct. 27, 2011, 9 pages.
PCT/US2010/039559—International Preliminary Report on Patentability dated Jan. 12, 2012, 7 pages.
PCT/US2010/039559—Notification of Transmittal of the International Search Report and the Written Opinion of the International Searching Authority, or the Declaration dated Sep. 1, 2010, 6 pages.
PCT/US2010/044476—International Search Report dated Sep. 29, 2010, 23 pages.
PCT/US2010/044681—International Search Report and Written Opinion dated Oct. 7, 2010, 10 pages.
PCT/US2010/044681—International Preliminary Report on Patentability dated Feb. 16, 2012, 9 pages.
PCT/US2010/049042—International Search Report and Written Opinion dated Nov. 17, 2010, 11 pages.
PCT/US2010/049042—International Preliminary Report on Patentability dated Mar. 29, 2012, 18 pages.
PCT/US2011/029486—International Preliminary Report on Patentability dated Sep. 25, 2012, 6 pages.
PCT/US2011/029486—International Search Report and Written Opinion dated Nov. 16, 2011, 9 pages.
PCT/US2011/062266—International Search Report and Written Opinion dated Jul. 9, 2012, 12 pages.
PCT/US2011/062198—International Search Report and Written Opinion dated Jul. 2, 2012, 9 pages.
PCT/US2011/062198—Extended European Search Report dated May 6, 2014, 9 pages.
PCT/US2011/062201—International Search Report and Written Opinion dated Jun. 26, 2012, 9 pages.
PCT/US2011/062201—Extended European Search Report dated May 28, 2014, 8 pages.
PCT/US2011/062204—International Search Report dated Nov. 1, 2012, 10 pages.
PCT/US2011/62207—International Search Report and Written Opinion dated Jun. 28, 2012, 7 pages.
PCT/US2012/000470—International Search Report dated Mar. 8, 2013, 10 pages.
PCT/US2012/061151—International Search Report and Written Opinion dated Feb. 25, 2013, 9 pages.
PCT/US2012/061159—International Search Report dated Mar. 2, 2013, 10 pages.
PCT/US2013/055547—Notification of Transmittal of the International Search Report and the Written Opinion of the International Searching Authority, or the Declaration dated Jan. 24, 2014, 11 pages.
PCT/US2013/064470—Notification of Transmittal of the International Search Report and the Written Opinion of the International Searching Authority, or the Declaration dated Jan. 22, 2014, 10 pages.
PCT/US2013/064471—Notification of Transmittal of the International Search Report and the Written Opinion of the International Searching Authority, or the Declaration dated Jan. 24, 2014, 10 pages.
PCT/US2014/013154—International Search Report dated May 23, 2014, 4 pages.
PCT/US2014/013170—Notification of Transmittal of the International Search Report and the Written Opinion of the International Searching Authority, or the Declaration, dated May 9, 2014, 12 pages.

(56) References Cited

OTHER PUBLICATIONS

PCT/US2014/023026—Notification of Transmittal of the International Search Report and the Written Opinion of the International Searching Authority, or the Declaration dated Jul. 22, 2014, 11 pages.
PCT/US2014/023990—Notification of Transmittal of the International Search Report and the Written Opinion of the International Searching Authority, or the Declaration dated Jul. 17, 2014, 10 pages.
PCT/US2014/026173—Notification of Transmittal of the International Search Report and the Written Opinion of the International Searching Authority, or the Declaration dated Jul. 9, 2014, 10 pages.
Persichilli, Michael, et al., "Supercritical CO2 Power Cycle Developments and Commercialization: Why SCO2 can Displace Steam", Echogen Power Systems, LLC, Power-Gen India & Central Asia 2012, Apr. 19-21, 2012, New Delhi, India, 15 pages.
Renz, Manfred, "The New Generation Kalina Cycle", Contribution to the Conference: Electricity Generation from Enhanced Geothermal Systems, Sep. 14, 2006, Strasbourg, France, 18 pages.
Saari, Henry, et al., "Supercritical CO2 Advanced Brayton Cycle Design", Presentation, Carleton University, Supercritical CO2 Power Cycle Symposium, May 24-25, 2011, Boulder, CO, 21 pages.
San Andres, Luis, "Start-Up Response of Fluid Film Lubricated Cryogenic Turbopumps (Preprint)", AIAA/ASME/SAE/ASEE Joint Propulsion Conference, Cincinnati, OH, Jul. 8-11, 2007, 38 pages.
Sarkar, J. and Bhattacharyya, Souvik, "Optimization of Recompression S-CO2 Power Cycle with Reheating", Energy Conversion and Management 50, May 17, 2009, pp. 1939-1945.
Thorin, Eva, "Power Cycles with Ammonia-Water Mixtures as Working Fluid", Doctoral Thesis, Department of Chemical Engineering and Technology Energy Processes, Royal Institute of Technology, Stockholm, Sweden, 2000, 66 pages.
Tom, Samsun Kwok Sun, "The Feasibility of Using Supercritical Carbon Dioxide as a Coolant for the Candu Reactor", The University of British Columbia, Jan. 1978, 156 pages.
VGB Powertech Service GMBH, "CO2 Capture and Storage", A VGB Report on the State of the Art, Aug. 25, 2004, 112 pages.
Vidhi, Rachana, et al., "Study of Supercritical Carbon Dioxide Power Cycle for Power Conversion from Low Grade Heat Sources", Presentation, University of South Florida and Oak Ridge National Laboratory, Supercritical CO2 Power Cycle Symposium, May 24-25, 2011, Boulder, CO, 17 pages.
Vidhi, Rachana, et al., "Study of Supercritical Carbon Dioxide Power Cycle for Power Conversion from Low Grade Heat Sources", Paper, University of South Florida and Oak Ridge National Laboratory, Supercritical CO2 Power Cycle Symposium, May 24-25, 2011, Boulder, CO, 8 pages.
Wright, Steven A., et al., "Modeling and Experimental Results for Condensing Supercritical CO2 Power Cycles", Sandia Report, Jan. 2011, 47 pages.
Wright, Steven A., et al., "Supercritical CO2 Power Cycle Development Summary at Sandia National Laboratories", May 24-25, 2011, 1 page, (Abstract Only).
Wright, Steven, "Mighty Mite", Mechanical Engineering, Jan. 2012, pp. 41-43.
Yoon, Ho Joon, et al., "Preliminary Results of Optimal Pressure Ratio for Supercritical CO2 Brayton Cycle Coupled with Small Modular Water Cooled Reactor", Presentation, Korea Advanced Institute of Science and Technology and Khalifa University of Science, Technology and Research, Boulder, CO, May 25, 2011, 18 pages.
Yoon, Ho Joon, et al., "Preliminary Results of Optimal Pressure Ratio for Supercritical CO2 Brayton Cycle Coupled with Small Modular Water Cooled Reactor", Paper, Korea Advanced Institute of Science and Technology and Khalifa University of Science, Technology and Research, May 24-25, 2011, Boulder, CO, 7 pages.

* cited by examiner

PROCESS FOR CONTROLLING A POWER TURBINE THROTTLE VALVE DURING A SUPERCRITICAL CARBON DIOXIDE RANKINE CYCLE

CROSS-REFERENCE TO RELATED APPLICATIONS

This application claims benefit of U.S. Prov. Appl. No. 61/757,590, filed on Jan. 28, 2013, the contents of which are hereby incorporated by reference to the extent not inconsistent with the present disclosure.

BACKGROUND

Waste heat is often created as a byproduct of industrial processes where flowing streams of high-temperature liquids, gases, or fluids must be exhausted into the environment or removed in some way in an effort to maintain the operating temperatures of the industrial process equipment. Some industrial processes utilize heat exchanger devices to capture and recycle waste heat back into the process via other process streams. However, the capturing and recycling of waste heat is generally infeasible by industrial processes that utilize high temperatures or have insufficient mass flow or other unfavorable conditions.

Waste heat can be converted into useful energy by a variety of heat engine or turbine generator systems that employ thermodynamic methods, such as Rankine cycles. Rankine cycles and similar thermodynamic methods are typically steam-based processes that recover and utilize waste heat to generate steam for driving a turbine, turbo, or other expander. An organic Rankine cycle utilizes a lower boiling-point working fluid, instead of water, during a traditional Rankine cycle. Exemplary lower boiling-point working fluids include hydrocarbons, such as light hydrocarbons (e.g., propane or butane) and halogenated hydrocarbon, such as hydrochlorofluorocarbons (HCFCs) or hydrofluorocarbons (HFCs) (e.g., R245fa). More recently, in view of issues such as thermal instability, toxicity, flammability, and production cost of the lower boiling-point working fluids, some thermodynamic cycles have been modified to circulate non-hydrocarbon working fluids, such as ammonia.

A synchronous power generator is a commonly employed turbine generator utilized for generating electrical energy in large scales (e.g., megawatt scale) throughout the world for both commercial and non-commercial use. The synchronous power generator generally supplies electricity to an electrical bus or grid (e.g., an alternating current bus) that usually has a varying load or demand over time. In order to be properly connected, the frequency of the synchronous power generator must be tuned and maintained to match the frequency of the electrical bus or grid. Severe damage may occur to the synchronous power generator as well as the electrical bus or grid should the frequency of the synchronous power generator become unsynchronized with the frequency of the electrical bus or grid.

Turbine generator systems also may suffer an overspeed condition during the generation of electricity—generally—due to high electrical demands during peak usage times. Turbine generator systems may be damaged due to an increasing rotational speed of the moving parts, such as a turbine, a generator, a shaft, and a gearbox. The overspeed condition often rapidly progresses out of control without immediate intervention to reduce the rotational speed of the turbine generator. The overspeed condition causes the temperatures and pressures of the working fluid to increase and the system to overheat. Once overheated, the turbine generator system may incur multiple problems that lead to catastrophic failures of the turbine generator system. The working fluid with an excess of absorbed heat may change to a different state of matter that is outside of the system design, such as a supercritical fluid becoming a subcritical state, gaseous state, or other state. The overheated working fluid may escape from the closed system causing further damage. Mechanical governor controls have been utilized to prevent or reduce overspeed conditions in analogous steam-powered generators. However, similar mechanical controls are unknown or not common for preventing or reducing overspeed conditions in turbine generator systems utilizing supercritical fluids.

Physical controllers and software controllers have been used to adjust independent aspects of turbine generator systems and process parameters. Such controllers may be utilized—in part—during a synchronous process or to avoid or minimize an overspeed condition. However, in the typical system, when a first controller is used to adjust a process parameter for manipulating a first variable, additional variables of the process generally become unfavorable and independent controllers are utilized to adjust different aspects of the process parameters while manipulating these variables. Such turbine generator systems that have multiple controllers are usually susceptible for failure and also suffer inefficiencies—which increase the cost to generate electricity.

What is needed, therefore, is a turbine generator system, a method for generating electrical energy, and an algorithm for such system and method, whereby the turbine generator system contains a control system with multiple controllers for maximizing the efficiency of the heat engine system while generating electrical energy.

SUMMARY

Embodiments of the invention generally provide a heat engine system, a method for generating electricity, and an algorithm for managing or controlling the heat engine system which are configured to efficiently transform thermal energy of a waste heat stream into valuable electrical energy. The heat engine system utilizes a working fluid in a supercritical state and/or a subcritical state contained within a working fluid circuit for capturing or otherwise absorbing the thermal energy of the waste heat stream. The thermal energy is transformed to mechanical energy by a power turbine and subsequently transformed to electrical energy by a power generator coupled to the power turbine. The heat engine system contains several integrated sub-systems managed by an overall control system that utilizes a control algorithm within multiple controllers for maximizing the efficiency of the heat engine system while generating electricity.

In one or more embodiments described herein, a heat engine system for generating electricity is provided and contains a working fluid circuit having a high pressure side, a low pressure side, and a working fluid circulated within the working fluid circuit, wherein at least a portion of the working fluid is in a supercritical state (e.g., sc-$CO_2$) and/or a subcritical state (e.g., sub-$CO_2$). The heat engine system further contains at least one heat exchanger fluidly coupled to the high pressure side of the working fluid circuit and in thermal communication with a heat source stream whereby thermal energy is transferred from the heat source stream to the working fluid. The heat engine system further contains a power turbine disposed between the high pressure side and the low pressure side of the working fluid circuit, fluidly coupled to and in thermal communication with the working fluid, and configured to convert a pressure drop in the working fluid to mechanical energy whereby the absorbed thermal energy of the working fluid is transformed to mechanical energy of the power turbine. The heat engine system further contains a power generator coupled to the power turbine and configured to convert the mechanical energy into electrical energy and a power outlet electrically coupled to the power generator and configured to transfer the electrical energy from the power generator to an electrical grid or bus. The heat engine system further contains a power turbine throttle valve fluidly coupled to the high pressure side of the working fluid circuit and configured to control a flow of the working fluid throughout the working fluid circuit. The heat engine system further contains a control system operatively connected to the working fluid circuit, enabled to monitor and control multiple process operation parameters of the heat engine system, and enabled to move, adjust, manipulate, or otherwise control the power turbine throttle valve for adjusting or controlling the flow of the working fluid.

In other embodiments described herein, a control algorithm is provided and utilized to manage the heat engine system and process for generating electricity. The control algorithm is embedded in a computer system and is part of the control system of the heat engine system. The control algorithm may be utilized throughout the various steps or processes described herein including while initiating and maintaining the heat engine system, as well as during a process upset or crisis event, and for maximizing the efficiency of the heat engine system while generating electricity. The control system and/or the control algorithm contains at least one system controller, but generally contains multiple system controllers utilized for managing the integrated subsystems of the heat engine system. Exemplary system controllers of the control algorithm include a trim controller, a power mode controller, a sliding mode controller, a pressure mode controller, an overspeed mode controller, a proportional integral derivative controller, a multi-mode controller, derivatives thereof, and/or combinations thereof.

In some examples, the control system or the control algorithm contains a trim controller configured to control rotational speed of the power turbine or the power generator. The trim controller may be configured to adjust the flow of the working fluid by modulating the power turbine throttle valve to increase or decrease rotational speed of the power turbine or the power generator during a synchronization process. The trim controller is provided by a proportional integral derivative (PID) controller within a generator control module as a portion of the control system of the heat engine system.

In other examples, the control system or the control algorithm contains a power mode controller configured to monitor a power output from the power generator and modulate the power turbine throttle valve in response to the power output while adaptively tuning the power turbine to maintain a power output from the power generator at a continuous or substantially continuous power level during a power mode process. The power mode controller may be configured to maintain the power output from the power generator at the continuous or substantially continuous power level during the power mode process while a load is increasing on the power generator.

In other examples, the control system or the control algorithm contains a sliding mode controller configured to monitor and detect an increase of rotational speed of the power turbine, the power generator, or a shaft coupled between the power turbine and the power generator. The sliding mode controller is further configured to adjust the flow of the working fluid by modulating the power turbine throttle valve to reduce the rotational speed after detecting the increase of rotational speed.

In other examples, the control system or the control algorithm contains a pressure mode controller configured to monitor and detect a reduction of pressure of the working fluid in the supercritical state within the working fluid circuit during a process upset. The pressure mode controller is further configured to adjust the flow of the working fluid by modulating the power turbine throttle valve to increase the pressure of the working fluid within the working fluid circuit during a pressure mode control process. In some examples, the control system or the control algorithm contains an overspeed mode controller configured to detect an overspeed condition and subsequently implement an overspeed mode control process to immediately reduce a rotational speed of the power turbine, the power generator, or a shaft coupled between the power turbine and the power generator.

In one example, the control system or the control algorithm contains a trim controller configured to adjust the flow of the working fluid by modulating the power turbine throttle valve to control a rotational speed of the power turbine while synchronizing the power generator with the electrical grid during a synchronization process and a power mode controller configured to adjust the flow of the working fluid by modulating the power turbine throttle valve to adaptively tune the power turbine while maintaining a power output from the power generator at a continuous or substantially continuous power level during a power mode process while increasing a load on the power generator. The control system or the control algorithm further contains a sliding mode controller configured to adjust the flow of the working fluid by modulating the power turbine throttle valve to gradually reduce the rotational speed during the process upset, a pressure mode controller configured to adjust the flow of the working fluid by modulating the power turbine throttle valve to increase the pressure of the working fluid in response to detecting a reduction of pressure of the working fluid throughout the working fluid circuit during a pressure mode control process, and an overspeed mode controller configured to adjust the flow of the working fluid by modulating the power turbine throttle valve to reduce the rotational speed during an overspeed condition.

In other embodiments described herein, a method for generating electricity with a heat engine system is provided and includes circulating the working fluid within a working fluid circuit having a high pressure side and a low pressure side, wherein at least a portion of the working fluid is in a supercritical state and transferring thermal energy from a heat source stream to the working fluid by at least one heat exchanger fluidly coupled to and in thermal communication with the high pressure side of the working fluid circuit. The method further includes transferring the thermal energy from the heated working fluid to a power turbine while converting a pressure drop in the heated working fluid to mechanical energy and converting the mechanical energy into electrical energy by a power generator coupled to the power turbine. The power turbine is generally disposed between the high pressure side and the low pressure side of the working fluid circuit and fluidly coupled to and in thermal communication with the working fluid. The method further includes transferring the electrical energy from the power generator to a power outlet, wherein the power outlet is electrically coupled to the power generator and configured to transfer the electrical energy from the power generator to an electrical grid or bus. The method further includes controlling the power turbine by operating a power turbine throttle valve to adjust a flow of the working fluid, wherein the power turbine throttle valve is fluidly coupled to the working fluid in the supercritical state within the high pressure side of the working fluid circuit upstream from the power turbine. The method further includes monitoring and controlling multiple process operation parameters of the heat engine system via a control system operatively connected to the working fluid circuit, wherein the control system is configured to control the power turbine by operating the power turbine throttle valve to adjust the flow of the working fluid. In many examples, the working fluid contains carbon dioxide and at least a portion of the carbon dioxide is in a supercritical state (e.g., sc-$CO_2$).

In some examples, the method further provides adjusting the flow of the working fluid by modulating, trimming, adjusting, or otherwise moving the power turbine throttle valve to control a rotational speed of the power turbine while synchronizing the power generator with the electrical grid during a synchronization process. In other examples, the method provides adjusting the flow of the working fluid by modulating the power turbine throttle valve while adaptively tuning the power turbine to maintain a power output of the power generator at a power level that is stable or continuous or at least substantially stable or continuous during a power mode process while experiencing an increasing load on the power generator. In some examples, the method includes detecting the process upset and subsequently adjusting the flow of the working fluid by modulating the power turbine throttle valve to increase the pressure of the working fluid within the working fluid circuit during a pressure mode control process. In other examples, a sliding mode controller may be configured to adjust the flow of the working fluid by modulating the power turbine throttle valve to gradually reduce the rotational speed and to prevent an overspeed condition. In other examples, the method includes detecting that the power turbine, the power generator, and/or the shaft is experiencing an overspeed condition and subsequently implementing an overspeed mode control process to immediately reduce the rotational speed. An overspeed mode controller may be configured to adjust the flow of the working fluid by modulating the power turbine throttle valve to reduce the rotational speed during the overspeed condition.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Embodiments of the invention generally provide a heat engine system, a method for generating electricity, and an algorithm for managing or controlling the heat engine system which are configured to efficiently transform thermal energy of a waste heat stream into valuable electrical energy. The heat engine system utilizes a working fluid in a supercritical state (e.g., sc-$CO_2$) and/or a subcritical state (e.g., sub-$CO_2$) contained within a working fluid circuit for capturing or otherwise absorbing the thermal energy of the waste heat stream. The thermal energy is transformed to mechanical energy by a power turbine and subsequently transformed to electrical energy by a power generator coupled to the power turbine. The heat engine system contains several integrated sub-systems managed by an overall control system that utilizes a control algorithm within multiple controllers for maximizing the efficiency of the heat engine system while generating electricity.

Figure 1:
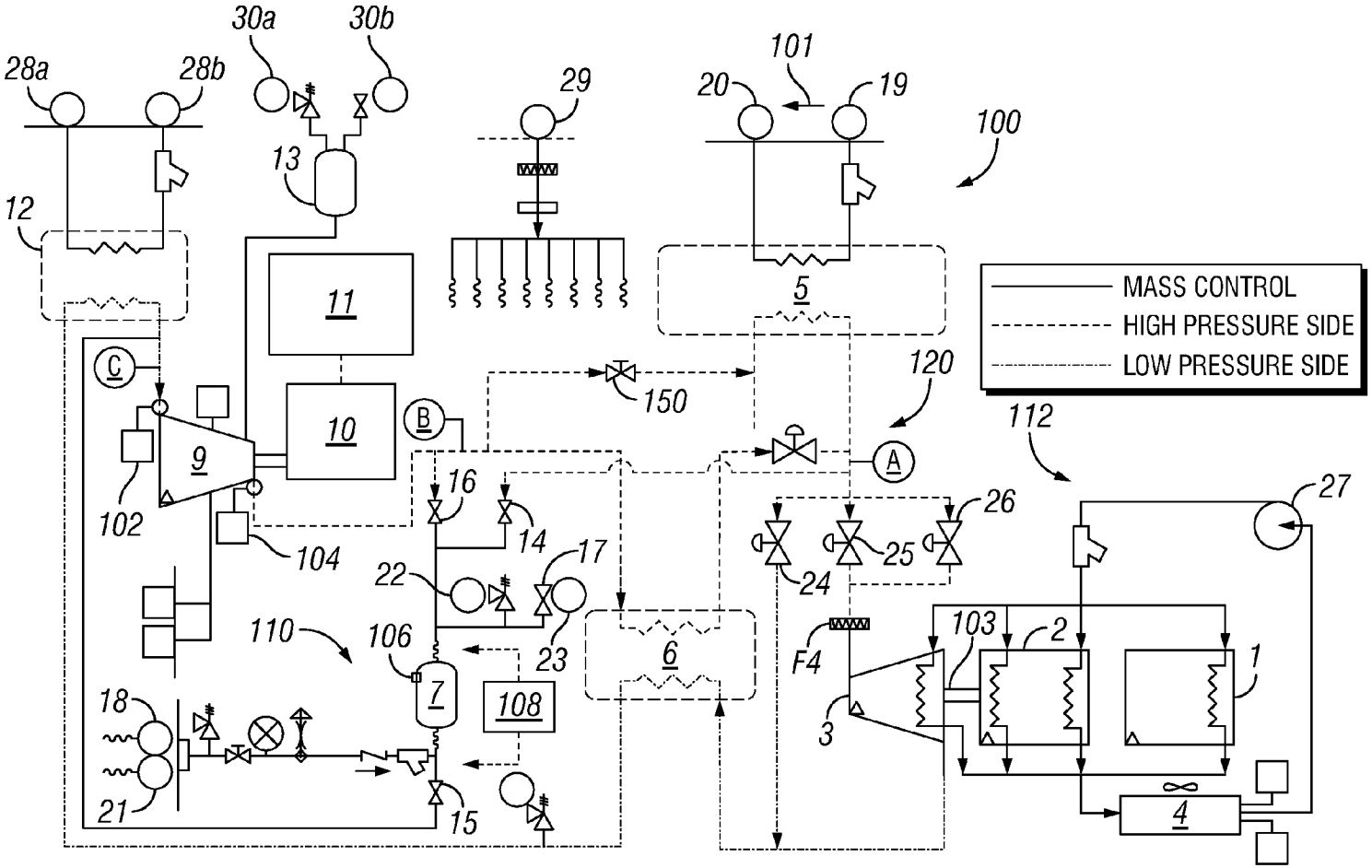
FIG. 1 illustrates an exemplary heat engine system, according to one or more embodiments disclosed herein.

FIG. 1 illustrates an exemplary heat engine system 100, which may also be referred to as a thermal engine system, a power generation system, a waste heat or other heat recovery system, and/or a thermal to electrical energy system, as described in one or more embodiments herein. The heat engine system 100 is generally configured to encompass one or more elements of a Rankine cycle, a derivative of a Rankine cycle, or another thermodynamic cycle for generating electrical energy from a wide range of thermal sources. The heat engine system 100 contains at least one heat exchanger, such as a heat exchanger 5 fluidly coupled to the high pressure side of the working fluid circuit 120 and in thermal communication with the heat source stream 101 via connection points 19 and 20. Such thermal communication provides the transfer of thermal energy from the heat source stream 101 to the working fluid flowing throughout the working fluid circuit 120.

The heat source stream 101 may be a waste heat stream such as, but not limited to, gas turbine exhaust stream, industrial process exhaust stream, or other combustion product exhaust streams, such as furnace or boiler exhaust streams. The heat source stream 101 may be at a temperature within a range from about 100° C. to about 1,000° C. or greater, and in some examples, within a range from about 200° C. to about 800° C., more narrowly within a range from about 300° C. to about 600° C. The heat source stream 101 may contain air, carbon dioxide, carbon monoxide, water or steam, nitrogen, oxygen, argon, derivatives thereof, or mixtures thereof. In some embodiments, the heat source stream 101 may derive thermal energy from renewable sources of thermal energy, such as solar or geothermal sources.

The heat engine system 100 further includes a power turbine 3 disposed between the high pressure side and the low pressure side of the working fluid circuit 120, disposed downstream from the heat exchanger 5, and fluidly coupled to and in thermal communication with the working fluid. The power turbine 3 is configured to convert a pressure drop in the working fluid to mechanical energy, whereby the absorbed thermal energy of the working fluid is transformed to mechanical energy of the power turbine 3. Therefore, the power turbine 3 is an expansion device capable of transforming a pressurized fluid into mechanical energy, generally, transforming high temperature and pressure fluid into mechanical energy, such as by rotating a shaft.

The power turbine 3 may contain or be a turbine, a turbo, an expander, or another device for receiving and expanding the working fluid discharged from the heat exchanger 5. The power turbine 3 may have an axial construction or radial construction and may be a single-staged device or a multi-staged device. Exemplary turbines that may be utilized in power turbine 3 include an expansion device, a geroler, a gerotor, a valve, other types of positive displacement devices such as a pressure swing, a turbine, a turbo, or any other device capable of transforming a pressure or pressure/enthalpy drop in a working fluid into mechanical energy. A variety of expanding devices are capable of working within the inventive system and achieving different performance properties that may be utilized as the power turbine 3.

The power turbine 3 is generally coupled to a power generator 2 by a shaft 103. A gearbox (not shown) is generally disposed between the power turbine 3 and the power generator 2 and adjacent to or encompassing the shaft 103. The shaft 103 may be a single piece or contain two or more pieces coupled together. In one example, a first segment of the shaft 103 extends from the power turbine 3 to the gearbox, a second segment of the shaft 103 extends from the gearbox to the power generator 2, and multiple gears are disposed between and couple to the two segments of the shaft 103 within the gearbox. In some configurations, the shaft 103 includes a seal assembly (not shown) designed to prevent or capture any working fluid leakage from the power turbine 3. Additionally, a working fluid recycle system may be implemented along with the seal assembly to recycle seal gas back into the fluid circuit of the heat engine system 100.

The power generator 2 may be a generator, an alternator (e.g., permanent magnet alternator), or other device for generating electrical energy, such as transforming mechanical energy from the shaft 103 and the power turbine 3 to electrical energy. A power outlet (not shown) is electrically coupled to the power generator 2 and configured to transfer the generated electrical energy from the power generator 2 to power electronics 1 or another electrical circuit. The electric circuit may include an electrical grid, an electrical bus (e.g., plant bus), power electronics, and/or combinations thereof.

In one example, the power generator 2 is an electric generator that is electrically and operably connected to an electrical grid or an electrical bus via the power outlet. The electrical grid or bus generally contains at least one alternating current bus, alternating current grid, alternating current circuit, or combinations thereof. In another example, the power generator 2 is an alternator and electrically that is operably connected to adjacent power electronics 1 via the power outlet. The power electronics 1 may be configured to convert the electrical power into desirable forms of electricity by modifying electrical properties, such as voltage, current, or frequency. The power electronics 1 may include converters or rectifiers, inverters, transformers, regulators, controllers, switches, resistors, storage devices, and other power electronic components and devices.

In other embodiments, the power generator 2 may be any other type of load receiving equipment, such as other types of electrical generation equipment, rotating equipment, a gearbox, or other device configured to modify or convert the shaft work created by the power turbine 3. In one embodiment, the power generator 2 is in fluid communication with a cooling loop 112 having a radiator 4 and a pump 27 for circulating a cooling fluid, such as water, thermal oils, and/or other suitable refrigerants. The cooling loop 112 may be configured to regulate the temperature of the power generator 2 and power electronics 1 by circulating the cooling fluid to draw away generated heat.

The heat engine system 100 also provides for the delivery of a portion of the working fluid into a chamber or housing of the power turbine 3 for purposes of cooling one or more parts of the power turbine 3. In one embodiment, due to the potential need for dynamic pressure balancing within the power generator 2, the selection of the site within the heat engine system 100 from which to obtain a portion of the working fluid is critical because introduction of this portion of the working fluid into the power generator 2 should respect or not disturb the pressure balance and stability of the power generator 2 during operation. Therefore, the pressure of the working fluid delivered into the power generator 2 for purposes of cooling is the same or substantially the same as the pressure of the working fluid at an inlet (not shown) of the power turbine 3. The working fluid is conditioned to be at a desired temperature and pressure prior to being introduced into the housing of the power turbine 3. A portion of the working fluid, such as the spent working fluid, exits the power turbine 3 at an outlet (not shown) of the power turbine 3 and is directed to the recuperator 6.

The working fluid flows or is otherwise directed from the heat exchanger 5 to the power turbine 3 via a valve 25, a valve 26, or combinations of valves 25, 26, prior to passing through filter F4 and into the power turbine 3. Valve 26 may be utilized in concert or simultaneously with valve 25 to increase the flowrate of the working fluid into the power turbine 3. Alternatively, valve 26 may be utilized as a bypass valve to valve 25 or as a redundancy valve instead of valve 25 in case of failure of or control loss to valve 25. The heat engine system 100 also contains a valve 24, which is generally a bypass valve, utilized to direct working fluid from the heat exchanger 5 to the recuperator 6. In one example, a portion of the working fluid in transit from the heat exchanger 5 to the power turbine 3 may be re-directed by having valves 25, 26 in closed positions and the valve 24 in an open position.

At least one recuperator, such as recuperator 6, may be disposed within the working fluid circuit 120 and fluidly coupled to the power turbine 3 downstream thereof and configured to remove at least a portion of the thermal energy in the working fluid discharged from the power turbine 3. The recuperator 6 transfers the removed thermal energy to the working fluid proceeding towards the heat exchanger 5. Therefore, the recuperator 6 is operative to transfer thermal energy between the high pressure side and the low pressure side of the working fluid circuit 120. A condenser or a cooler (not shown) may be fluidly coupled to the recuperator 6 and in thermal communication with the low pressure side of the working fluid circuit 120, the condenser or the cooler being operative to control a temperature of the working fluid in the low pressure side of the working fluid circuit 120.

The heat engine system 100 further contains a pump 9 disposed within the working fluid circuit 120 and fluidly coupled between the low pressure side and the high pressure side of the working fluid circuit 120. The pump 9 is operative to circulate the working fluid through the working fluid circuit 120. A condenser 12 is fluidly coupled to the pump 9, such that pump 9 receives the cooled working fluid and pressurizes the working fluid circuit 120 to recirculate the working fluid back to the heat exchanger 5. The condenser 12 is fluidly coupled with a cooling system (not shown) that receives a cooling fluid from a supply line **28*a* and returns the warmed cooling fluid to the cooling system via a return line 28*b*. The cooling fluid may be water, carbon dioxide, or other aqueous and/or organic fluids or various mixtures thereof that is maintained at a lower temperature than the working fluid. The pump 9 is also coupled with a relief tank 13, which in turn is coupled with a pump vent 30***a* and relief 30*b*, such as for carbon dioxide. In one embodiment, the pump 9 is driven by a motor 10, and the speed of the motor 10 may be regulated using, for example, a variable frequency drive 11.

In some embodiments, the types of working fluid that may be circulated, flowed, or otherwise utilized in the working fluid circuit 120 of the heat engine system 100 include carbon oxides, hydrocarbons, alcohols, ketones, halogenated hydrocarbons, ammonia, amines, aqueous, or combinations thereof. Exemplary working fluids that may be utilized in the heat engine system 100 include carbon dioxide, ammonia, methane, ethane, propane, butane, ethylene, propylene, butylene, acetylene, methanol, ethanol, acetone, methyl ethyl ketone, water, derivatives thereof, or mixtures thereof. Halogenated hydrocarbons may include hydrochlorofluorocarbons (HCFCs), hydrofluorocarbons (HFCs) (e.g., 1,1,1,3,3-pentafluoropropane (R245fa)), fluorocarbons, derivatives thereof, or mixtures thereof.

In many embodiments described herein, the working fluid circulated, flowed, or otherwise utilized in the working fluid circuit 120 of the heat engine system 100, and the other exemplary circuits disclosed herein, may be or may contain carbon dioxide ($CO_2$) and mixtures containing carbon dioxide. Generally, at least a portion of the working fluid circuit 120 contains the working fluid in a supercritical state (e.g., sc-$CO_2$). Carbon dioxide utilized as the working fluid or contained in the working fluid for power generation cycles has many advantages over other compounds typical used as working fluids, since carbon dioxide has the properties of being non-toxic and non-flammable and is also easily available and relatively inexpensive. Due in part to a relatively high working pressure of carbon dioxide, a carbon dioxide system may be much more compact than systems using other working fluids. The high density and volumetric heat capacity of carbon dioxide with respect to other working fluids makes carbon dioxide more "energy dense" meaning that the size of all system components can be considerably reduced without losing performance. It should be noted that use of the terms carbon dioxide ($CO_2$), supercritical carbon dioxide (sc-$CO_2$), or subcritical carbon dioxide (sub-$CO_2$) is not intended to be limited to carbon dioxide of any particular type, source, purity, or grade. For example, industrial grade carbon dioxide may be contained in and/or used as the working fluid without departing from the scope of the disclosure.

In other exemplary embodiments, the working fluid in the working fluid circuit 120 may be a binary, ternary, or other working fluid blend. The working fluid blend or combination can be selected for the unique attributes possessed by the fluid combination within a heat recovery system, as described herein. For example, one such fluid combination includes a liquid absorbent and carbon dioxide mixture enabling the combined fluid to be pumped in a liquid state to high pressure with less energy input than required to compress carbon dioxide. In another exemplary embodiment, the working fluid may be a combination of supercritical carbon dioxide (sc-$CO_2$), subcritical carbon dioxide (sub-$CO_2$), and/or one or more other miscible fluids or chemical compounds. In yet other exemplary embodiments, the working fluid may be a combination of carbon dioxide and propane, or carbon dioxide and ammonia, without departing from the scope of the disclosure.

The working fluid circuit 120 generally has a high pressure side and a low pressure side and contains a working fluid circulated within the working fluid circuit 120. The use of the term "working fluid" is not intended to limit the state or phase of matter of the working fluid. For instance, the working fluid or portions of the working fluid may be in a fluid phase, a gas phase, a supercritical state, a subcritical state, or any other phase or state at any one or more points within the heat engine system 100 or thermodynamic cycle. In one or more embodiments, the working fluid is in a supercritical state over certain portions of the working fluid circuit 120 of the heat engine system 100 (e.g., a high pressure side) and in a subcritical state over other portions of the working fluid circuit 120 of the heat engine system 100 (e.g., a low pressure side). FIG. 1 depicts the high and low pressure sides of the working fluid circuit 120 of the heat engine system 100 by representing the high pressure side with "------" and the low pressure side with "-·-·-"—as described in one or more embodiments. In other embodiments, the entire thermodynamic cycle may be operated such that the working fluid is maintained in either a supercritical or subcritical state throughout the entire working fluid circuit 120 of the heat engine system 100. FIG. 1 also depicts a mass management system 110 of the working fluid circuit 120 in the heat engine system 100 by representing the mass control system with "——", as described in one or more embodiments.

Generally, the high pressure side of the working fluid circuit 120 contains the working fluid (e.g., sc-$CO_2$) at a pressure of about 15 MPa or greater, such as about 17 MPa or greater or about 20 MPa or greater. In some examples, the high pressure side of the working fluid circuit 120 may have a pressure within a range from about 15 MPa to about 30 MPa, more narrowly within a range from about 16 MPa to about 26 MPa, more narrowly within a range from about 17 MPa to about 25 MPa, and more narrowly within a range from about 17 MPa to about 24 MPa, such as about 23.3 MPa. In other examples, the high pressure side of the working fluid circuit 120 may have a pressure within a range from about 20 MPa to about 30 MPa, more narrowly within a range from about 21 MPa to about 25 MPa, and more narrowly within a range from about 22 MPa to about 24 MPa, such as about 23 MPa.

The low pressure side of the working fluid circuit 120 contains the working fluid (e.g., $CO_2$ or sub-$CO_2$) at a pressure of less than 15 MPa, such as about 12 MPa or less or about 10 MPa or less. In some examples, the low pressure side of the working fluid circuit 120 may have a pressure within a range from about 4 MPa to about 14 MPa, more narrowly within a range from about 6 MPa to about 13 MPa, more narrowly within a range from about 8 MPa to about 12 MPa, and more narrowly within a range from about 10 MPa to about 11 MPa, such as about 10.3 MPa. In other examples, the low pressure side of the working fluid circuit 120 may have a pressure within a range from about 2 MPa to about 10 MPa, more narrowly within a range from about 4 MPa to about 8 MPa, and more narrowly within a range from about 5 MPa to about 7 MPa, such as about 6 MPa.

In some examples, the high pressure side of the working fluid circuit 120 may have a pressure within a range from about 17 MPa to about 23.5 MPa, and more narrowly within a range from about 23 MPa to about 23.3 MPa while the low pressure side of the working fluid circuit 120 may have a pressure within a range from about 8 MPa to about 11 MPa, and more narrowly within a range from about 10.3 MPa to about 11 MPa.

FIG. 1 depicts a throttle valve 150 (e.g., a power turbine throttle valve) fluidly coupled to the high pressure side of the working fluid circuit 120 and upstream from the heat exchanger 5, as described in one or more embodiments. The throttle valve 150 may be configured to control a flow of the working fluid throughout the working fluid circuit 120 and to the power turbine 3. Generally, the working fluid is in a supercritical state while flowing through the high pressure side of the working fluid circuit 120. The throttle valve 150 may be controlled by a control system 108 that is also communicably connected, wired and/or wirelessly, with the throttle valve 150 and other parts of the heat engine system 100. The control system 108 is operatively connected to the working fluid circuit 120 and a mass management system 110 and is enabled to monitor and control multiple process operation parameters of the heat engine system 100. A computer system, as part of the control system 108, contains a multi-controller algorithm utilized to control the throttle valve 150. The multi-controller algorithm has multiple modes to control the throttle valve 150 for efficiently executing the processes of generating electricity by the heat engine system 100, as described herein. The control system 108 is enabled to move, adjust, manipulate, or otherwise control the throttle valve 150 for adjusting or controlling the flow of the working fluid throughout the working fluid circuit 120. By controlling the flow of the working fluid, the control system 108 is also operable to regulate the temperatures and pressures throughout the working fluid circuit 120.

Further, in certain embodiments, the control system 108, as well as any other controllers or processors disclosed herein, may include one or more non-transitory, tangible, machine-readable media, such as read-only memory (ROM), random access memory (RAM), solid state memory (e.g., flash memory), floppy diskettes, CD-ROMs, hard drives, universal serial bus (USB) drives, any other computer readable storage medium, or any combination thereof. The storage media may store encoded instructions, such as firmware, that may be executed by the control system 108 to operate the logic or portions of the logic presented in the methods disclosed herein. For example, in certain embodiments, the heat engine system 100 may include computer code disposed on a computer-readable storage medium or a process controller that includes such a computer-readable storage medium. The computer code may include instructions for initiating a control function to alternate the position of the throttle valve 150 in accordance with the disclosed embodiments.

In one or more embodiments described herein, a control algorithm is provided and utilized to manage the heat engine system 100 and process for generating electricity. The control algorithm is embedded in a computer system as part of the control system 108 of the heat engine system 100. The control algorithm may be utilized throughout the various steps or processes described herein including while initiating and maintaining the heat engine system 100, as well as during a process upset or crisis event, and for maximizing the efficiency of the heat engine system 100 while generating electricity. The control algorithm contains at least one system controller, but generally contains multiple system controllers utilized for managing the integrated sub-systems of the heat engine system 100. Exemplary system controllers of the control algorithm include a trim controller, a power mode controller, a sliding mode controller, a pressure mode controller, an overspeed mode controller, a proportional integral derivative controller, a multi-mode controller, derivatives thereof, and/or combinations thereof.

In some examples, the control algorithm contains a trim controller configured to control rotational speed of the power turbine 3 or the power generator 2. The trim controller may be configured to adjust the flow of the working fluid by modulating the throttle valve 150 to increase or decrease rotational speed of the power turbine 3 or the power generator 2 during a synchronization process. The trim controller is provided by a proportional integral derivative (PID) controller within a generator control module as a portion of the control system 108 of the heat engine system 100.

In other examples, the control algorithm contains a power mode controller configured to monitor a power output from the power generator 2 and modulate the throttle valve 150 in response to the power output while adaptively tuning the power turbine 3 to maintain a power output from the power generator 2 at a continuous or substantially continuous power level during a power mode process. The power mode controller may be configured to maintain the power output from the power generator 2 at the continuous or substantially continuous power level during the power mode process while a load is increasing on the power generator 2.

In other examples, the control algorithm contains a sliding mode controller configured to monitor and detect an increase of rotational speed of the power turbine 3, the power generator 2, or the shaft 103 coupled between the power turbine 3 and the power generator 2. The sliding mode controller is further configured to adjust the flow of the working fluid by modulating the throttle valve 150 to reduce the rotational speed after detecting the increase of rotational speed.

In other examples, the control algorithm contains a pressure mode controller configured to monitor and detect a reduction of pressure of the working fluid in the supercritical state within the working fluid circuit 120 during a process upset. The pressure mode controller is further configured to adjust the flow of the working fluid by modulating the throttle valve 150 to increase the pressure of the working fluid within the working fluid circuit 120 during a pressure mode control process. In some examples, the control algorithm contains an overspeed mode controller configured to detect an overspeed condition and subsequently implement an overspeed mode control process to immediately reduce a rotational speed of the power turbine 3, the power generator 2, or a shaft 103 coupled between the power turbine 3 and the power generator 2.

In one example, the control algorithm, embedded in a computer system as part of the control system 108 for the heat engine system 100, contains at least: (i.) a trim controller configured to adjust the flow of the working fluid by modulating the throttle valve 150 to control a rotational speed of the power turbine 3 while synchronizing the power generator 2 with an electrical circuit, such as an electrical grid or an electrical bus (e.g., plant bus) or power electronics 1 during a synchronization process; (ii.) a power mode controller configured to adjust the flow of the working fluid by modulating the throttle valve 150 to adaptively tune the power turbine 3 while maintaining a power output from the power generator 2 at a continuous or substantially continuous power level during a power mode process while increasing a load on the power generator 2; (iii.) a sliding mode controller configured to adjust the flow of the working fluid by modulating the throttle valve 150 to gradually reduce the rotational speed during the process upset; (iv.) a pressure mode controller configured to adjust the flow of the working fluid by modulating the throttle valve 150 to increase the pressure of the working fluid in response to detecting a reduction of pressure of the working fluid in the supercritical state within the working fluid circuit 120 during a pressure mode control process; and (v.) an overspeed mode controller configured to adjust the flow of the working fluid by modulating the throttle valve 150 to reduce the rotational speed during an overspeed condition.

Figure 2:
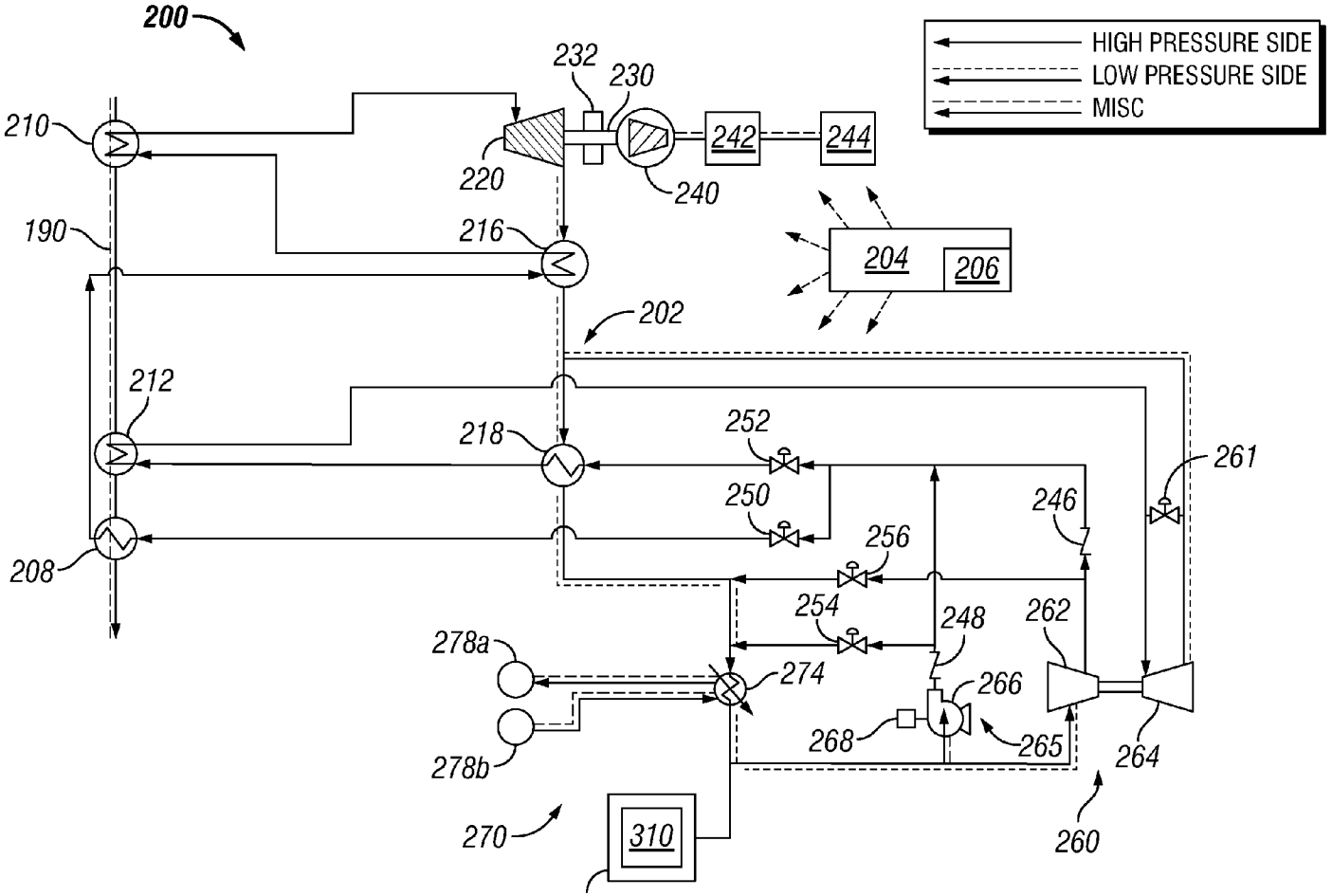
FIG. 2 illustrates another exemplary heat engine system, according to one or more embodiments disclosed herein.
Figure 4:
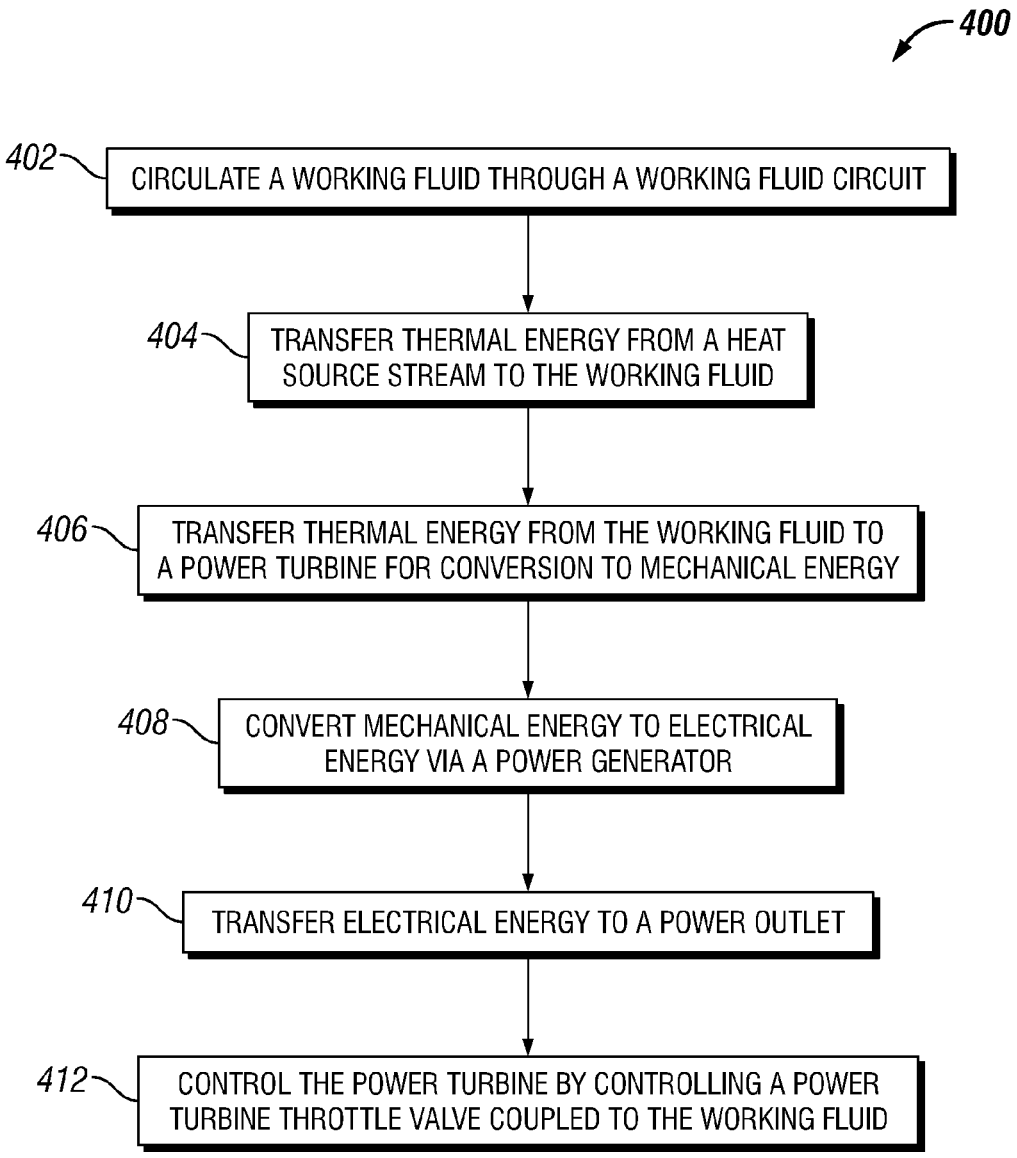
FIG. 4 illustrates a flow chart of an embodiment of a method for generating electricity with a heat engine system.

In other embodiments described herein, as illustrated in FIG. 4, a method 400 for generating electricity with a heat engine system 100 is provided and includes circulating a working fluid within a working fluid circuit 120 having a high pressure side and a low pressure side, such that at least a portion of the working fluid is in a supercritical state (e.g., sc-$CO_2$) (block 402). The method 400 also includes transferring thermal energy from a heat source stream 101 to the working fluid by at least one heat exchanger 210 fluidly coupled to and in thermal communication with the high pressure side of the working fluid circuit 120, as depicted in FIG. 2 (block 404).

The method 400 further includes transferring the thermal energy from the heated working fluid to a power turbine 3 while converting a pressure drop in the heated working fluid to mechanical energy (block 406) and converting the mechanical energy into electrical energy by a power generator 2 coupled to the power turbine 3 (block 408), wherein the power turbine 3 is disposed between the high pressure side and the low pressure side of the working fluid circuit 120 and fluidly coupled to and in thermal communication with the working fluid. The method 400 further includes transferring the electrical energy from the power generator 2 to a power outlet (block 410) and from the power outlet to the power electronics 1 and/or an electrical circuit, such as an electrical grid, an electrical bus.

The method 400 further includes controlling the power turbine 3 by operating a throttle valve 150 to adjust a flow of the working fluid (block 412). The throttle valve 150 is fluidly coupled to the working fluid in the supercritical state within the high pressure side of the working fluid circuit 120 upstream from the power turbine 3. The method further includes monitoring and controlling multiple process operation parameters of the heat engine system 100 via a control system 108 operatively connected to the working fluid circuit 120, wherein the control system 108 is configured to control the power turbine 3 by operating the throttle valve 150 to adjust the flow of the working fluid. In many examples, the working fluid contains carbon dioxide and at least a portion of the carbon dioxide is in a supercritical state (e.g., sc-$CO_2$).

In some examples, the method further provides adjusting the flow of the working fluid by modulating, trimming, adjusting, or otherwise moving the throttle valve 150 to control a rotational speed of the power turbine 3 while synchronizing the power generator 2 with the electrical grid or bus (not shown) during a synchronization process. Therefore, the throttle valve 150 may be modulated to control the rotational speed of the power turbine 3 which in turn controls the rotational speed of the power generator 2 as well as the shaft 103 disposed between and coupled to the power turbine 3 and the power generator 2. The throttle valve 150 may be modulated between a fully opened position, a partially opened position, a partially closed position, or a fully closed position. A trim controller, as part of the control system 108, may be utilized to control the rotational speed of the power turbine 3. The generator control module provides an output signal in relation to a phase difference between a generator frequency of the power generator 2 and a grid frequency of the electrical grid or bus. Generally, the electrical grid or bus contains at least one alternating current bus, alternating current circuit, alternating current grid, or combinations thereof. Additionally, a breaker on the power generator 2 may be closed once the power turbine 3 is synchronized with the power generator 2. In one embodiment, the trim controller for adjusting the fine trim may be activated once the generator frequency is within about +/−10 degrees of phase of the grid frequency. Also, a course trim controller for adjusting the course trim may be activated once a phase value of the grid frequency is outside of about 10 degrees of a predetermined "phase window".

In other examples, the method provides adjusting the flow of the working fluid by modulating the throttle valve 150 while adaptively tuning the power turbine 3 to maintain a power output of the power generator 2 at a power level that is stable or continuous or at least substantially stable or continuous during a power mode process, even though the power generator 2 experiences a changing demand in load. Generally, the load on the power generator 2 is increasing during the power mode process while a power mode controller adaptively tunes the power turbine 3 by modulating the throttle valve 150 to maintain a substantially stable or continuous power level. In some examples, the method includes monitoring the power output from the power generator 2 with the power mode controller as part of the control system 108, and modulating the throttle valve 150 with the power mode controller to adaptively tune the power turbine 3 in response to the power output.

In other examples, the method provides monitoring and detecting a reduction of pressure of the working fluid in the supercritical state within the working fluid circuit 120 during a process upset. In some examples, the method includes detecting the process upset and subsequently adjusting the flow of the working fluid by modulating the throttle valve 150 to increase the pressure of the working fluid within the working fluid circuit 120 during a pressure mode control process. A pressure mode controller may be configured to adjust the flow of the working fluid by modulating the throttle valve 150 to increase the pressure during the process upset.

In other examples, a sliding mode control process may be implemented to protect the power turbine 3, the power generator 2, the shaft 103, or the gearbox (not shown) from an overspeed condition. The method provides monitoring for a change in the rotational speed of the power turbine 3, the power generator 2, or a shaft 103 coupled between the power turbine 3 and the power generator 2 during the process upset. Upon detecting the increase of rotational speed during the process upset—the method includes adjusting the flow of the working fluid by modulating the throttle valve 150 to gradually reduce the rotational speed. A sliding mode controller may be configured to adjust the flow of the working fluid by modulating the throttle valve 150 to gradually reduce the rotational speed and to prevent an overspeed condition. Alternatively, upon detecting a decrease of rotational speed during the process upset—the method includes adjusting the flow of the working fluid by modulating the throttle valve 150 to gradually increase the rotational speed.

In other examples, the method includes detecting that the power turbine 3, the power generator 2, and/or the shaft 103 is experiencing an overspeed condition and subsequently implementing an overspeed mode control process to immediately reduce the rotational speed. An overspeed mode controller may be configured to adjust the flow of the working fluid by modulating the throttle valve 150 to reduce the rotational speed during the overspeed condition.

In some embodiments, the overall efficiency of the heat engine system 100 and the amount of power ultimately generated can be influenced by the inlet or suction pressure at the pump 9 when the working fluid contains supercritical carbon dioxide. In order to minimize or otherwise regulate the suction pressure of the pump 9, the heat engine system 100 may incorporate the use of a mass management system ("MMS") 110. The mass management system 110 controls the inlet pressure of the pump 9 by regulating the amount of working fluid entering and/or exiting the heat engine system 100 at strategic locations in the working fluid circuit 120, such as at tie-in points A, B, and C. Consequently, the heat engine system 100 becomes more efficient by increasing the pressure ratio for the pump 9 to a maximum possible extent.

The mass management system 110 has a vessel or tank, such as a storage vessel, a working fluid vessel, or the mass control tank 7, fluidly coupled to the low and high pressure sides of the working fluid circuit 120 via one or more valves. The valves are moveable—as being partially opened, fully opened, and/or closed—to either remove working fluid from the working fluid circuit 120 or add working fluid to the working fluid circuit 120. Exemplary embodiments of the mass management system 110, and a range of variations thereof, are found in U.S. application Ser. No. 13/278,705, filed Oct. 21, 2011, and published as U.S. Pub. No. 2012-0047892, the contents of which are incorporated herein by reference to the extent consistent with the present disclosure. Briefly, however, the mass management system 110 may include a plurality of valves and/or connection points 14, 15, 16, 17, 18, 21, 22, and 23, each in fluid communication with a mass control tank 7. The valves 14, 15, and 16 may be characterized as termination points where the mass management system 110 is operatively connected to the heat engine system 100. The connection points 18, 21, 22, and 23 and valve 17 may be configured to provide the mass management system 110 with an outlet for flaring excess working fluid or pressure, or to provide the mass management system 110 with additional/supplemental working fluid from an external source, such as a fluid fill system, as described herein.

The first valve 14 fluidly couples the mass management system 110 to the heat engine system 100 at or near tie-in point A, where the working fluid is heated and pressurized after being discharged from the heat exchanger 5. The second valve 15 fluidly couples the mass management system 110 to the heat engine system 100 at or near tie-in point C, arranged adjacent the inlet to the pump 9, where the working fluid is generally at a low temperature and pressure. The third valve 16 fluidly couples the mass management system 110 to the heat engine system 100 at or near tie-in point B, where the working fluid is more dense and at a higher pressure relative to the density and pressure on the low pressure side of the heat engine system 100 (e.g., adjacent tie-in point C).

The mass control tank 7 may be configured as a localized storage for additional/supplemental working fluid that may be added to the heat engine system 100 when needed in order to regulate the pressure or temperature of the working fluid within the fluid circuit or otherwise supplement escaped working fluid. By controlling the valves 14, 15, and 16, the mass management system 110 adds and/or removes working fluid mass to/from the heat engine system 100 without the need of a pump, thereby reducing system cost, complexity, and maintenance. For example, the mass control tank 7 is pressurized by opening the first valve 14 to allow high-temperature, high-pressure working fluid to flow into the mass control tank 7 via tie-in point A. Once pressurized, additional/supplemental working fluid may be injected back into the fluid circuit from the mass control tank 7 via the second valve 15 and tie-in point C. Adjusting the position of the second valve 15 may serve to continuously regulate the inlet pressure of the pump 9. The third valve 16 may be opened to remove working fluid from the fluid circuit at tie-in point B and deliver that working fluid to the mass control tank 7.

The mass management system 110 may operate with the heat engine system 100 semi-passively with the aid of first, second, and third sets of sensors 102, 104, and 106, respectively. The first set of sensors 102 is arranged at or adjacent the suction inlet of the pump 9 and the second set of sensors 104 is arranged at or adjacent the outlet of the pump 9. The first and second sets of sensors 102, 104 monitor and report the pressure, temperature, mass flowrate, or other properties of the working fluid within the low and high pressure sides of the fluid circuit adjacent the pump 9. The third set of sensors 106 is arranged either inside or adjacent the mass control tank 7 to measure and report the pressure, temperature, mass flowrate, or other properties of the working fluid within the tank 7.

The control system 108 is also communicably connected, wired and/or wirelessly, with each set of sensors 102, 104, and 106 in order to process the measured and reported temperatures, pressures, and mass flowrates of the working fluid at the designated points. In response to these measured and/or reported parameters, the control system 108 may be operable to selectively adjust the valves 14, 15, and 16 in accordance with a control program or algorithm, thereby maximizing operation of the heat engine system 100. Additionally, an instrument air supply 29 may be coupled to sensors, devices, or other instruments within the heat engine system 100 including the mass management system 110 and/or other system components that may utilize a gaseous supply, such as nitrogen or air.

Of the connection points 18, 21, 22, and 23 and valve 17, at least one connection point, such as connection point 21, may be a fluid fill port for the mass management system 110. Additional/supplemental working fluid may be added to the mass management system 110 from an external source, such as a fluid fill system via the fluid fill port or connection point 21. Exemplary fluid fill systems are described and illustrated in U.S. Pat. No. 8,281,593, the contents of which are incorporated herein by reference to the extent consistent with the present disclosure.

FIG. 2 illustrates an exemplary heat engine system 200, which may also be referred to as a thermal engine system, a power generation system, a waste heat or other heat recovery system, and/or a thermal to electrical energy system, as described in one or more embodiments herein. The heat engine system 200 is generally configured to encompass one or more elements of a Rankine cycle, a derivative of a Rankine cycle, or another thermodynamic cycle for generating electrical energy from a wide range of thermal sources. The heat engine system 200 contains at least one heat exchanger, such as a heat exchanger 210, fluidly coupled to the high pressure side of the working fluid circuit 202 and in thermal communication with the heat source stream 190. Such thermal communication provides the transfer of thermal energy from the heat source stream 190 to the working fluid flowing throughout the working fluid circuit 202.

The heat source stream 190 may be a waste heat stream such as, but not limited to, gas turbine exhaust stream, industrial process exhaust stream, or other combustion product exhaust streams, such as furnace or boiler exhaust streams. The heat source stream 190 may be at a temperature within a range from about 100° C. to about 1,000° C. or greater, and in some examples, within a range from about 200° C. to about 800° C., more narrowly within a range from about 300° C. to about 600° C. The heat source stream 190 may contain air, carbon dioxide, carbon monoxide, water or steam, nitrogen, oxygen, argon, derivatives thereof, or mixtures thereof. In some embodiments, the heat source stream 190 may derive thermal energy from renewable sources of thermal energy, such as solar or geothermal sources.

The heat engine system 200 further contains a power turbine 220 disposed between the high pressure side and the low pressure side of the working fluid circuit 202, disposed downstream from the heat exchanger 210, and fluidly coupled to and in thermal communication with the working fluid. The power turbine 220 is configured to convert a pressure drop in the working fluid to mechanical energy whereby the absorbed thermal energy of the working fluid is transformed to mechanical energy of the power turbine 220. Therefore, the power turbine 220 is an expansion device capable of transforming a pressurized fluid into mechanical energy, generally, transforming high temperature and pressure fluid into mechanical energy, such as rotating a shaft.

The power turbine 220 may contain or be a turbine, a turbo, an expander, or another device for receiving and expanding the working fluid discharged from the heat exchanger 210. The power turbine 220 may have an axial construction or radial construction and may be a single-staged device or a multi-staged device. Exemplary turbines that may be utilized in power turbine 220 include an expansion device, a geroler, a gerotor, a valve, other types of positive displacement devices such as a pressure swing, a turbine, a turbo, or any other device capable of transforming a pressure or pressure/enthalpy drop in a working fluid into mechanical energy. A variety of expanding devices are capable of working within the inventive system and achieving different performance properties that may be utilized as the power turbine 220.

The power turbine 220 is generally coupled to a power generator 240 by a shaft 230. A gearbox 232 is generally disposed between the power turbine 220 and the power generator 240 and adjacent or encompassing the shaft 230. The shaft 230 may be a single piece or contain two or more pieces coupled together. In one example, a first segment of the shaft 230 extends from the power turbine 220 to the gearbox 232, a second segment of the shaft 230 extends from the gearbox 232 to the power generator 240, and multiple gears are disposed between and couple to the two segments of the shaft 230 within the gearbox 232. In some configurations, the shaft 230 includes a seal assembly (not shown) designed to prevent or capture any working fluid leakage from the power turbine 220. Additionally, a working fluid recycle system may be implemented along with the seal assembly to recycle seal gas back into the fluid circuit of the heat engine system 200.

The power generator 240 may be a generator, an alternator (e.g., permanent magnet alternator), or other device for generating electrical energy, such as transforming mechanical energy from the shaft 230 and the power turbine 220 to electrical energy. A power outlet 242 is electrically coupled to the power generator 240 and configured to transfer the generated electrical energy from the power generator 240 to an electrical grid 244. The electrical grid 244 may be or include an electrical grid, an electrical bus (e.g., plant bus), power electronics, other electric circuits, or combinations thereof. The electrical grid 244 generally contains at least one alternating current bus, alternating current grid, alternating current circuit, or combinations thereof. In one example, the power generator 240 is a generator and is electrically and operably connected to the electrical grid 244 via the power outlet 242. In another example, the power generator 240 is an alternator and is electrically and operably connected to power electronics (not shown) via the power outlet 242. In another example, the power generator 240 is electrically connected to power electronics which are electrically connected to the power outlet 242.

The power electronics may be configured to convert the electrical power into desirable forms of electricity by modifying electrical properties, such as voltage, current, or frequency. The power electronics may include converters or rectifiers, inverters, transformers, regulators, controllers, switches, resistors, storage devices, and other power electronic components and devices. In other embodiments, the power generator 240 may contain, be coupled with, or be other types of load receiving equipment, such as other types of electrical generation equipment, rotating equipment, a gearbox (e.g., gearbox 232), or other device configured to modify or convert the shaft work created by the power turbine 220. In one embodiment, the power generator 240 is in fluid communication with a cooling loop having a radiator and a pump for circulating a cooling fluid, such as water, thermal oils, and/or other suitable refrigerants. The cooling loop may be configured to regulate the temperature of the power generator 240 and power electronics by circulating the cooling fluid to draw away generated heat.

The heat engine system 200 also provides for the delivery of a portion of the working fluid into a chamber or housing of the power turbine 220 for purposes of cooling one or more parts of the power turbine 220. In one embodiment, due to the potential need for dynamic pressure balancing within the power generator 240, the selection of the site within the heat engine system 200 from which to obtain a portion of the working fluid is critical because introduction of this portion of the working fluid into the power generator 240 should respect or not disturb the pressure balance and stability of the power generator 240 during operation. Therefore, the pressure of the working fluid delivered into the power generator 240 for purposes of cooling is the same or substantially the same as the pressure of the working fluid at an inlet (not shown) of the power turbine 220. The working fluid is conditioned to be at a desired temperature and pressure prior to being introduced into the housing of the power turbine 220. A portion of the working fluid, such as the spent working fluid, exits the power turbine 220 at an outlet (not shown) of the power turbine 220 and is directed to one or more heat exchangers or recuperators, such as recuperators 216 and 218. The recuperators 216 and 218 may be fluidly coupled with the working fluid circuit 202 in series with each other. The recuperators 216 and 218 are operative to transfer thermal energy between the high pressure side and the low pressure side of the working fluid circuit 202.

In one embodiment, the recuperator 216 is fluidly coupled to the low pressure side of the working fluid circuit 202, disposed downstream from a working fluid outlet on the power turbine 220, disposed upstream from the recuperator 218 and/or the condenser 274, and configured to remove at least a portion of the thermal energy from the working fluid discharged from the power turbine 220. In addition, the recuperator 216 is also fluidly coupled to the high pressure side of the working fluid circuit 202, disposed upstream from the heat exchanger 210 and/or a working fluid inlet on the power turbine 220, disposed downstream from the heat exchanger 208, and configured to increase the amount of thermal energy in the working fluid prior to flowing into the heat exchanger 210 and/or the power turbine 220. Therefore, the recuperator 216 is a heat exchanger configured to cool the low pressurized working fluid discharged or downstream from the power turbine 220 while heating the high pressurized working fluid entering into or upstream from the heat exchanger 210 and/or the power turbine 220.

Similarly, in another embodiment, the recuperator 218 is fluidly coupled to the low pressure side of the working fluid circuit 202, disposed downstream from a working fluid outlet on the power turbine 220 and/or the recuperator 216, disposed upstream from the condenser 274, and configured to remove at least a portion of the thermal energy from the working fluid discharged from the power turbine 220 and/or the recuperator 216. In addition, the recuperator 218 is also fluidly coupled to the high pressure side of the working fluid circuit 202, disposed upstream from the heat exchanger 212 and/or a working fluid inlet on a drive turbine 264 of turbo pump 260, disposed downstream from a working fluid outlet on a pump portion 262 of turbo pump 260, and configured to increase the amount of thermal energy in the working fluid prior to flowing into the heat exchanger 212 and/or the drive turbine 264. Therefore, the recuperator 218 is a heat exchanger configured to cool the low pressurized working fluid discharged or downstream from the power turbine 220 and/or the recuperator 216 while heating the high pressurized working fluid entering into or upstream from the heat exchanger 212 and/or the drive turbine 264.

In some examples, an additional condenser or a cooler (not shown) may be fluidly coupled to each of the recuperators 216 and 218 and in thermal communication with the low pressure side of the working fluid circuit 202, the condenser or the cooler is operative to control a temperature of the working fluid in the low pressure side of the working fluid circuit 202.

The heat engine system 200 further contains several pumps, such as a turbo pump 260 and a start pump 265, disposed within the working fluid circuit 202 and fluidly coupled between the low pressure side and the high pressure side of the working fluid circuit 202. The turbo pump 260 and the start pump 265 are operative to circulate the working fluid throughout the working fluid circuit 202. The start pump 265 is utilized to initially pressurize and circulate the working fluid in the working fluid circuit 202. Once a predetermined pressure, temperature, and/or flowrate of the working fluid is obtained within the working fluid circuit 202, the start pump 265 may be taken off line, idled, or turned off and the turbo pump 260 is utilize to circulate the working fluid during the electricity generation process. The working fluid enters each of the turbo pump 260 and the start pump 265 from the low pressure side of the working fluid circuit 202 and exits each of the turbo pump 260 and the start pump 265 from the high pressure side of the working fluid circuit 202.

The start pump 265 is generally a motorized pump, such as an electrical motorized pump, a mechanical motorized pump, or any other suitable type of pump. Generally, the start pump 265 may be a variable frequency motorized drive pump and contains a pump portion 266 and a motor-drive portion 268. The motor-drive portion 268 of the start pump 265 contains a motor and the drive including a drive shaft and gears. In some examples, the motor-drive portion 268 has a variable frequency drive, such that the speed of the motor may be regulated by the drive. The pump portion 266 of the start pump 265 is driven by the motor-drive portion 268 coupled thereto. The pump portion 266 has an inlet for receiving the working fluid from the low pressure side of the working fluid circuit 202, such as from the condenser 274 and/or the working fluid storage system 300. The pump portion 266 has an outlet for releasing the working fluid into the high pressure side of the working fluid circuit 202.

The turbo pump 260 is a turbo-drive pump or a turbine-drive pump and utilized to pressurize and circulate the working fluid throughout the working fluid circuit 202. The turbo pump 260 contains a pump portion 262 and a drive turbine 264 coupled together by a drive shaft and optional gearbox. The pump portion 262 of the turbo pump 260 is driven by the drive shaft coupled to the drive turbine 264. The pump portion 262 has an inlet for receiving the working fluid from the low pressure side of the working fluid circuit 202, such as from the condenser 274 and/or the working fluid storage system 300. The pump portion 262 has an outlet for releasing the working fluid into the high pressure side of the working fluid circuit 202.

The drive turbine 264 of the turbo pump 260 is driven by the working fluid heated by the heat exchanger 212. The drive turbine 264 has an inlet for receiving the working fluid flowing from the heat exchanger 212 in the high pressure side of the working fluid circuit 202. The drive turbine 264 has an outlet for releasing the working fluid into the low pressure side of the working fluid circuit 202. In one configuration, the working fluid released from the outlet on the drive turbine 264 is returned into the working fluid circuit 202 downstream from the recuperator 216 and upstream from the recuperator 218.

A bypass valve 261 is generally coupled between and in fluid communication with a fluid line extending from the inlet on the drive turbine 264 and a fluid line extending from the outlet on the drive turbine 264. The bypass valve 261 may be opened to bypass the drive turbine 264 while using the start pump 265 during the initial stages of generating electricity with the heat engine system 200. Once a predetermined pressure and temperature of the working fluid is obtained within the working fluid circuit 202, the bypass valve 261 may be closed and the heated working fluid is flowed through the drive turbine 264 to start the turbo pump 260.

Control valve 246 is disposed downstream from the outlet of the pump portion 262 of the turbo pump 260 and control valve 248 is disposed downstream from the outlet of the pump portion 266 of the start pump 265. Control valves 246 and 248 are flow control safety valves and generally utilized to regulate the directional flow or to prohibit backflow of the working fluid within the working fluid circuit 202. Bypass valves 254 and 256 are independently disposed within the working fluid circuit 202 and fluidly coupled between the low pressure side and the high pressure side of the working fluid circuit 202. Therefore, the working fluid flows through each of the bypass valves 254 and 256 from the high pressure side of the working fluid circuit 202 and exits each of the bypass valves 254 and 256 to the low pressure side of the working fluid circuit 202.

A cooler or condenser 274 is fluidly coupled to the turbo pump 260 and/or the start pump 265 and receives the cooled working fluid and pressurizes the working fluid circuit 202 to recirculate the working fluid back to the heat exchanger 210. The condenser 274 is fluidly coupled with a cooling system (not shown) that receives a cooling fluid from a cooling fluid supply **278*a* and returns the warmed cooling fluid to the cooling system via a cooling fluid return 278*b***. The cooling fluid may be water, carbon dioxide, or other aqueous and/or organic fluids or various mixtures thereof that is maintained at a lower temperature than the working fluid.

In some embodiments, the types of working fluid that may be circulated, flowed, or otherwise utilized in the working fluid circuit 202 of the heat engine system 200 include carbon oxides, hydrocarbons, alcohols, ketones, halogenated hydrocarbons, ammonia, amines, aqueous, or combinations thereof. Exemplary working fluids that may be utilized in the heat engine system 200 include carbon dioxide, ammonia, methane, ethane, propane, butane, ethylene, propylene, butylene, acetylene, methanol, ethanol, acetone, methyl ethyl ketone, water, derivatives thereof, or mixtures thereof. Halogenated hydrocarbons may include hydrochlorofluorocarbons (HCFCs), hydrofluorocarbons (HFCs) (e.g., 1,1,1,3,3-pentafluoropropane (R245fa)), fluorocarbons, derivatives thereof, or mixtures thereof.

In many embodiments described herein, the working fluid circulated, flowed, or otherwise utilized in the working fluid circuit 202 of the heat engine system 200, and the other exemplary circuits disclosed herein, may be or may contain carbon dioxide ($CO_2$) and mixtures containing carbon dioxide. Generally, at least a portion of the working fluid circuit 202 contains the working fluid in a supercritical state (e.g., sc-$CO_2$). Carbon dioxide utilized as the working fluid or contained in the working fluid for power generation cycles has many advantages over other compounds typically used as working fluids, since carbon dioxide has the properties of being non-toxic and non-flammable and is also easily available and relatively inexpensive. Due in part to a relatively high working pressure of carbon dioxide, a carbon dioxide system may be much more compact than systems using other working fluids. The high density and volumetric heat capacity of carbon dioxide with respect to other working fluids makes carbon dioxide more "energy dense," meaning that the size of all system components can be considerably reduced without losing performance. It should be noted that use of the terms carbon dioxide ($CO_2$), supercritical carbon dioxide (sc-$CO_2$), or subcritical carbon dioxide (sub-$CO_2$) is not intended to be limited to carbon dioxide of any particular type, source, purity, or grade. For example, industrial grade carbon dioxide may be contained in and/or used as the working fluid without departing from the scope of the disclosure.

In other exemplary embodiments, the working fluid in the working fluid circuit 202 may be a binary, ternary, or other working fluid blend. The working fluid blend or combination can be selected for the unique attributes possessed by the fluid combination within a heat recovery system, as described herein. For example, one such fluid combination includes a liquid absorbent and carbon dioxide mixture enabling the combined fluid to be pumped in a liquid state to high pressure with less energy input than required to compress carbon dioxide. In another exemplary embodiment, the working fluid may be a combination of supercritical carbon dioxide (sc-$CO_2$), subcritical carbon dioxide (sub-$CO_2$), and/or one or more other miscible fluids or chemical compounds. In yet other exemplary embodiments, the working fluid may be a combination of carbon dioxide and propane, or carbon dioxide and ammonia, without departing from the scope of the disclosure.

The working fluid circuit 202 generally has a high pressure side and a low pressure side and contains a working fluid circulated within the working fluid circuit 202. The use of the term "working fluid" is not intended to limit the state or phase of matter of the working fluid. For instance, the working fluid or portions of the working fluid may be in a fluid phase, a gas phase, a supercritical state, a subcritical state, or any other phase or state at any one or more points within the heat engine system 200 or thermodynamic cycle. In one or more embodiments, the working fluid is in a supercritical state over certain portions of the working fluid circuit 202 of the heat engine system 200 (e.g., a high pressure side) and in a subcritical state over other portions of the working fluid circuit 202 of the heat engine system 200 (e.g., a low pressure side). FIG. 2 depicts the high and low pressure sides of the working fluid circuit 202 of the heat engine system 200 by representing the high pressure side with a "—" line and the low pressure side with the combined "-------" and "—" lines (as shown in key on FIG. 2)—as described in one or more embodiments. In other embodiments, the entire thermodynamic cycle may be operated such that the working fluid is maintained in either a supercritical or subcritical state throughout the entire working fluid circuit 202 of the heat engine system 200. FIG. 2 also depicts other components or portions of the working fluid circuit 202 in the heat engine system 200 by representing the miscellaneous portions of the working fluid circuit 202 with the combined "--" and "—" lines (as shown in key on FIG. 2), as described in one or more embodiments.

Generally, the high pressure side of the working fluid circuit 202 contains the working fluid (e.g., sc-$CO_2$) at a pressure of about 15 MPa or greater, such as about 17 MPa or greater or about 20 MPa or greater. In some examples, the high pressure side of the working fluid circuit 202 may have a pressure within a range from about 15 MPa to about 30 MPa, more narrowly within a range from about 16 MPa to about 26 MPa, more narrowly within a range from about 17 MPa to about 25 MPa, and more narrowly within a range from about 17 MPa to about 24 MPa, such as about 23.3 MPa. In other examples, the high pressure side of the working fluid circuit 202 may have a pressure within a range from about 20 MPa to about 30 MPa, more narrowly within a range from about 21 MPa to about 25 MPa, and more narrowly within a range from about 22 MPa to about 24 MPa, such as about 23 MPa.

The low pressure side of the working fluid circuit 202 contains the working fluid (e.g., $CO_2$ or sub-$CO_2$) at a pressure of less than 15 MPa, such as about 12 MPa or less or about 10 MPa or less. In some examples, the low pressure side of the working fluid circuit 202 may have a pressure within a range from about 4 MPa to about 14 MPa, more narrowly within a range from about 6 MPa to about 13 MPa, more narrowly within a range from about 8 MPa to about 12 MPa, and more narrowly within a range from about 10 MPa to about 11 MPa, such as about 10.3 MPa. In other examples, the low pressure side of the working fluid circuit 202 may have a pressure within a range from about 2 MPa to about 10 MPa, more narrowly within a range from about 4 MPa to about 8 MPa, and more narrowly within a range from about 5 MPa to about 7 MPa, such as about 6 MPa.

In some examples, the high pressure side of the working fluid circuit 202 may have a pressure within a range from about 17 MPa to about 23.5 MPa, and more narrowly within a range from about 23 MPa to about 23.3 MPa while the low pressure side of the working fluid circuit 202 may have a pressure within a range from about 8 MPa to about 11 MPa, and more narrowly within a range from about 10.3 MPa to about 11 MPa.

FIG. 2 further depicts a power turbine throttle valve 250 fluidly coupled to the high pressure side of the working fluid circuit 202 and upstream from the heat exchanger 210, as disclosed by at least one embodiment described herein. Additionally, FIG. 2 depicts a drive turbine throttle valve 252 fluidly coupled to the high pressure side of the working fluid circuit 202 and upstream from the heat exchanger 212, as disclosed by another embodiment described herein. The power turbine throttle valve 250 and the drive turbine throttle valve 252 are configured to control a flow of the working fluid throughout the working fluid circuit 202 and to the power turbine 220 and drive turbine 264, respectively.

Generally, the working fluid is in a supercritical state while flowing through the high pressure side of the working fluid circuit 202. The power turbine throttle valve 250 may be controlled by a control system 204 that also communicably connected, wired and/or wirelessly, with the power turbine throttle valve 250 and other parts of the heat engine system 200. The control system 204 is operatively connected to the working fluid circuit 202 and a mass management system 270 and is enabled to monitor and control multiple process operation parameters of the heat engine system 200. A computer system 206, as part of the control system 204, contains a multi-controller algorithm utilized to control the power turbine throttle valve 250. The multi-controller algorithm has multiple modes to control the power turbine throttle valve 250 for efficiently executing the processes of generating electricity by the heat engine system 200, as described herein. The control system 204 is enabled to move, adjust, manipulate, or otherwise control the power turbine throttle valve 250 for adjusting or controlling the flow of the working fluid throughout the working fluid circuit 202. By controlling the flow of the working fluid, the control system 204 is also operable to regulate the temperatures and pressures throughout the working fluid circuit 202.

In some embodiments, the overall efficiency of the heat engine system 200 and the amount of power ultimately generated can be influenced by the inlet or suction pressure at the start pump 265 when the working fluid contains supercritical carbon dioxide. In order to minimize or otherwise regulate the suction pressure of the start pump 265, the heat engine system 200 may incorporate the use of a mass management system ("MMS") 270. The mass management system 270 controls the inlet pressure of the start pump 265 by regulating the amount of working fluid entering and/or exiting the heat engine system 200 at strategic locations in the working fluid circuit 202, such as at tie-in points, inlets/outlets, valves, or conduits throughout the heat engine system 200. Consequently, the heat engine system 200 becomes more efficient by increasing the pressure ratio for the start pump 265 to a maximum possible extent.

The mass management system 270 has a vessel or tank, such as a storage vessel, a working fluid vessel, or the mass control tank, fluidly coupled to the low and high pressure sides of the working fluid circuit 202 via one or more valves. In some examples, a working fluid storage vessel 310 is part of a working fluid storage system 300. The valves are moveable—as being partially opened, fully opened, and/or closed—to either remove working fluid from the working fluid circuit 202 or add working fluid to the working fluid circuit 202. The mass management system 270 and exemplary fluid fill systems that may be utilized with the heat engine system 200 may be the same as or similar to the mass management system 110 and exemplary fluid fill systems that may be utilized with the heat engine system 100 described herein.

The control system 204 is also communicably connected, wired and/or wirelessly, with each set of sensors in order to process the measured and reported temperatures, pressures, and mass flowrates of the working fluid at the designated points. In response to these measured and/or reported parameters, the control system 204 may be operable to selectively adjust the valves in accordance with a control program or algorithm, thereby maximizing operation of the heat engine system 200.

The control system 204 and/or the mass management system 270 may operate with the heat engine system 200 semi-passively with the aid of several sets of sensors. The first set of sensors is arranged at or adjacent the suction inlet of the pumps 260, 265 and the second set of sensors is arranged at or adjacent the outlet of the pumps 260, 265. The first and second sets of sensors monitor and report the pressure, temperature, mass flowrate, or other properties of the working fluid within the low and high pressure sides of the fluid circuit adjacent the pumps 260, 265. The third set of sensors is arranged either inside or adjacent the working fluid storage vessel 310 of the working fluid storage system 300 to measure and report the pressure, temperature, mass flowrate, or other properties of the working fluid within the working fluid storage vessel 310.

Figure 3:
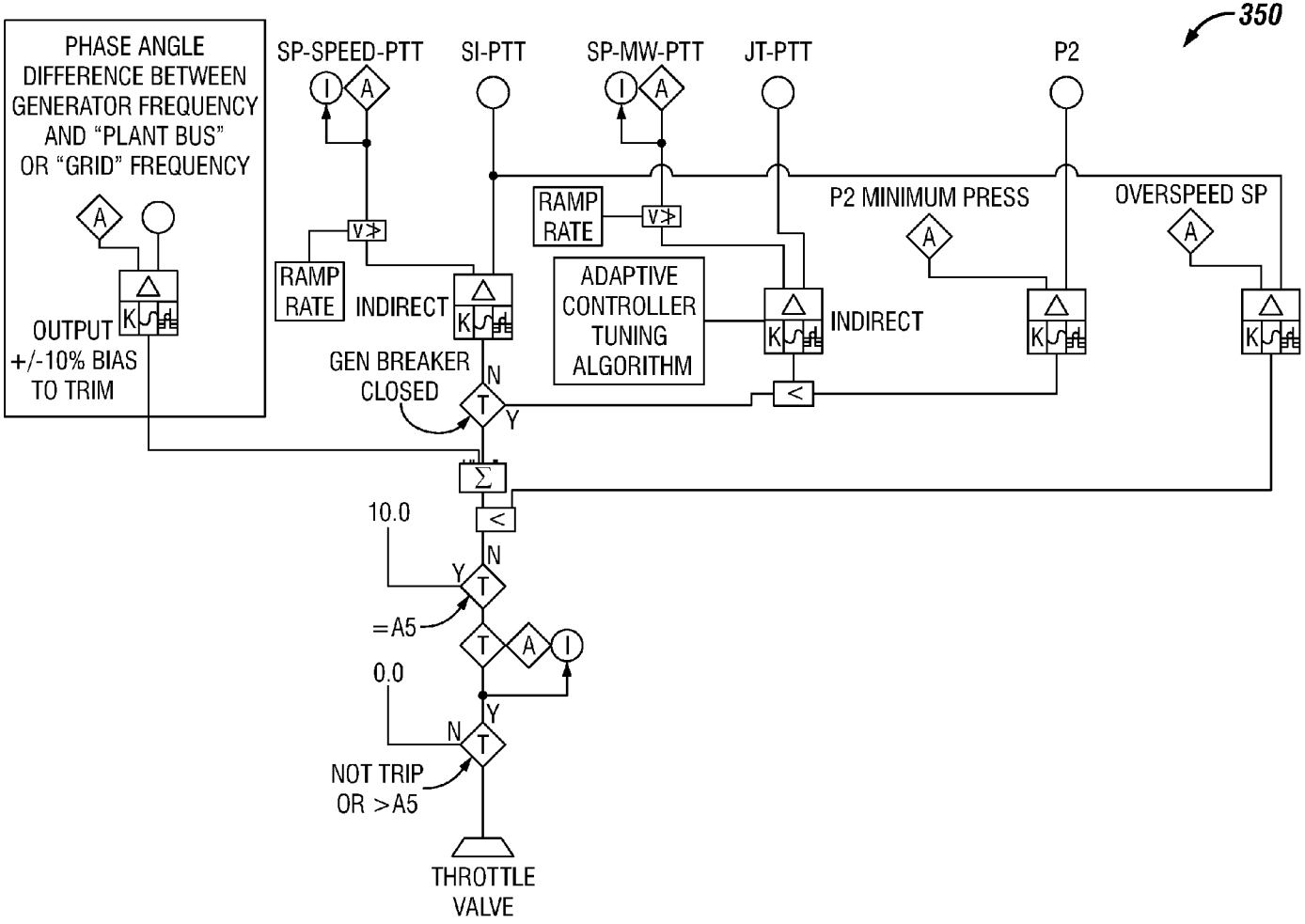
FIG. 3 illustrates a schematic diagram of an exemplary control system with a plurality of controllers for heat engine systems, according to one or more embodiments disclosed herein.

In one or more embodiments described herein, a control algorithm is provided and utilized to manage the heat engine system 200 and process for generating electricity. FIG. 3 depicts an exemplary scheme 350 of the control algorithm that may be utilized to manage, operate, adjust, modulate, or otherwise control the throttle valve 150 disposed within the heat engine system 100 (FIG. 1), as well as the power turbine throttle valve 250 and the drive turbine throttle valve 252 disposed within the heat engine system 200 (FIG. 2).

The control algorithm may be embedded in the computer system 206 as part of the control system 204 of the heat engine system 200. The control algorithm may be utilized throughout the various steps or processes described herein including while initiating and maintaining the heat engine system 200, as well as during a process upset or crisis event, and for maximizing the efficiency of the heat engine system 200 while generating electricity. The control system 204 or the control algorithm contains for at least one system controller, but generally contains multiple system controllers utilized for managing the integrated sub-systems of the heat engine system 200. Exemplary system controllers include a trim controller, a power mode controller, a sliding mode controller, a pressure mode controller, an overspeed mode controller, a proportional integral derivative controller, a multi-mode controller, derivatives thereof, and/or combinations thereof.

In some examples, the control system 204 or the control algorithm contains a trim controller configured to control rotational speed of the power turbine 220 or the power generator 240. The trim controller may be configured to adjust the flow of the working fluid by modulating the power turbine throttle valve 250 to increase or decrease rotational speed of the power turbine 220 or the power generator 240 during a synchronization process. The trim controller is provided by a proportional integral derivative (PID) controller within a generator control module as a portion of the control system 204 of the heat engine system 200.

In other examples, the control system 204 or the control algorithm contains a power mode controller configured to monitor a power output from the power generator 240 and modulate the power turbine throttle valve 250 in response to the power output while adaptively tuning the power turbine 220 to maintain a power output from the power generator 240 at a continuous or substantially continuous power level during a power mode process. The power mode controller may be configured to maintain the power output from the power generator 240 at the continuous or substantially continuous power level during the power mode process while a load is increasing on the power generator 240.

In other examples, the control system 204 or the control algorithm contains a sliding mode controller configured to monitor and detect an increase of rotational speed of the power turbine 220, the power generator 240, or the shaft 230 coupled between the power turbine 220 and the power generator 240. The sliding mode controller is further configured to adjust the flow of the working fluid by modulating the power turbine throttle valve 250 to reduce the rotational speed after detecting the increase of rotational speed.

In other examples, the control system 204 or the control algorithm contains a pressure mode controller configured to monitor and detect a reduction of pressure of the working fluid in the supercritical state within the working fluid circuit 202 during a process upset. The pressure mode controller is further configured to adjust the flow of the working fluid by modulating the power turbine throttle valve 250 to increase the pressure of the working fluid within the working fluid circuit 202 during a pressure mode control process. In some examples, the control system 204 or the control algorithm contains an overspeed mode controller configured to detect an overspeed condition and subsequently implement an overspeed mode control process to immediately reduce a rotational speed of the power turbine 220, the power generator 240, or a shaft 230 coupled between the power turbine 220 and the power generator 240.

In one example, the control algorithm, embedded in the computer system 206 as part of the control system 204 for the heat engine system 200. The control system 204 and/or the control algorithm contains at least: (i.) a trim controller configured to adjust the flow of the working fluid by modulating the power turbine throttle valve 250 to control a rotational speed of the power turbine 220 while synchronizing the power generator 240 with the electrical grid 244, such as an electrical grid, an electrical bus (e.g., plant bus), power electronics, or other circuit during a synchronization process; (ii.) a power mode controller configured to adjust the flow of the working fluid by modulating the power turbine throttle valve 250 to adaptively tune the power turbine 220 while maintaining a power output from the power generator 240 at a continuous or substantially continuous power level during a power mode process while increasing a load on the power generator 240; (iii.) a sliding mode controller configured to adjust the flow of the working fluid by modulating the power turbine throttle valve 250 to gradually reduce the rotational speed during the process upset; (iv.) a pressure mode controller configured to adjust the flow of the working fluid by modulating the power turbine throttle valve 250 to increase the pressure of the working fluid in response to detecting a reduction of pressure of the working fluid in the supercritical state within the working fluid circuit 202 during a pressure mode control process; and (v.) an overspeed mode controller configured to adjust the flow of the working fluid by modulating the power turbine throttle valve 250 to reduce the rotational speed during an overspeed condition.

In other embodiments described herein, a method for generating electricity with a heat engine system 200 is provided and includes circulating a working fluid within a working fluid circuit 202 having a high pressure side and a low pressure side, wherein at least a portion of the working fluid is in a supercritical state (e.g., sc-$CO_2$) and transferring thermal energy from a heat source stream 190 to the working fluid by at least one heat exchanger 210 fluidly coupled to and in thermal communication with the high pressure side of the working fluid circuit 202. The method further includes transferring the thermal energy from the heated working fluid to a power turbine 220 while converting a pressure drop in the heated working fluid to mechanical energy and converting the mechanical energy into electrical energy by a power generator 240 coupled to the power turbine 220. The power turbine 220 is generally disposed between the high pressure side and the low pressure side of the working fluid circuit 202 and fluidly coupled to and in thermal communication with the working fluid.

The method further includes transferring the electrical energy from the power generator 240 to a power outlet 242 and from the power outlet 242 to the electrical grid 244, such as an electrical grid, an electrical bus, power electronics, or other electrical circuits. The power outlet 242 is electrically coupled to the power generator 240 and configured to transfer the electrical energy from the power generator 240 to an electrical grid 244. The method further includes controlling the power turbine 220 by operating a power turbine throttle valve 250 to adjust a flow of the working fluid. The power turbine throttle valve 250 is fluidly coupled to the working fluid in the supercritical state within the high pressure side of the working fluid circuit 202 upstream from the power turbine 220. In another example, the drive turbine throttle valve 252 is fluidly coupled to the working fluid in the supercritical state within the high pressure side of the working fluid circuit 202 upstream from the drive turbine 264 of the turbo pump 260.

The method further includes monitoring and controlling multiple process operation parameters of the heat engine system 200 via a control system 204 operatively connected to the working fluid circuit 202, wherein the control system 204 is configured to control the power turbine 220 by operating the power turbine throttle valve 250 to adjust the flow of the working fluid. In many examples, the working fluid contains carbon dioxide and at least a portion of the carbon dioxide is in a supercritical state (e.g., sc-$CO_2$).

In some examples, the method further provides adjusting the flow of the working fluid by modulating, trimming, adjusting, or otherwise moving the power turbine throttle valve 250 to control a rotational speed of the power turbine 220 while synchronizing the power generator 240 with the electrical grid or bus (not shown) during a synchronization process. Therefore, the power turbine throttle valve 250 may be modulated to control the rotational speed of the power turbine 220 which in turn controls the rotational speed of the power generator 240 as well as the shaft 230 disposed between and coupled to the power turbine 220 and the power generator 240. The power turbine throttle valve 250 may be modulated between a fully opened position, a partially opened position, a partially closed position, or a fully closed position. A trim controller, as part of the control system 204, may be utilized to control the rotational speed of the power turbine 220. The generator control module provides an output signal in relation to a phase difference between a generator frequency of the power generator 240 and a grid frequency of the electrical grid or bus. Generally, the electrical grid or bus contains at least one alternating current bus, alternating current circuit, alternating current grid, or combinations thereof. Additionally, a breaker on the power generator 240 may be closed once the power turbine 220 is synchronized with the power generator 240. In one embodiment, the trim controller for adjusting the fine trim may be activated once the generator frequency is within about +/−10 degrees of phase of the grid frequency. Also, a course trim controller for adjusting the course trim may be activated once a phase value of the grid frequency is outside of about 10 degrees of a predetermined "phase window".

In other examples, the method provides adjusting the flow of the working fluid by modulating the power turbine throttle valve 250 while adaptively tuning the power turbine 220 to maintain a power output of the power generator 240 at a power level that is stable or continuous or at least substantially stable or continuous during a power mode process, even though the power generator 240 experiences a changing demand in load. Generally, the load on the power generator 240 is increasing during the power mode process while a power mode controller adaptively tunes the power turbine 220 by modulating the power turbine throttle valve 250 to maintain a substantially stable or continuous power level. In some examples, the method includes monitoring the power output from the power generator 240 with the power mode controller as part of the control system 204, and modulating the power turbine throttle valve 250 with the power mode controller to adaptively tune the power turbine 220 in response to the power output.

In other examples, the method provides monitoring and detecting a reduction of pressure of the working fluid in the supercritical state within the working fluid circuit 202 during a process upset. In some examples, the method includes detecting the process upset and subsequently adjusting the flow of the working fluid by modulating the power turbine throttle valve 250 to increase the pressure of the working fluid within the working fluid circuit 202 during a pressure mode control process. A pressure mode controller may be configured to adjust the flow of the working fluid by modulating the power turbine throttle valve 250 to increase the pressure during the process upset.

In other examples, a sliding mode control process may be implemented to protect the power turbine 220, the power generator 240, the shaft 230, and/or the gearbox 232 from an overspeed condition. The method provides monitoring for a change in the rotational speed of the power turbine 220, the power generator 240, or a shaft 230 coupled between the power turbine 220 and the power generator 240 during the process upset. Upon detecting the increase of rotational speed during the process upset, the method includes adjusting the flow of the working fluid by modulating the power turbine throttle valve 250 to gradually reduce the rotational speed. A sliding mode controller may be configured to adjust the flow of the working fluid by modulating the power turbine throttle valve 250 to gradually reduce the rotational speed and to prevent an overspeed condition. Alternatively, upon detecting a decrease of rotational speed during the process upset, the method includes adjusting the flow of the working fluid by modulating the power turbine throttle valve 250 to gradually increase the rotational speed.

In other examples, the method includes detecting that the power turbine 220, the power generator 240, and/or the shaft 230 is experiencing an overspeed condition and subsequently implementing an overspeed mode control process to immediately reduce the rotational speed. An overspeed mode controller may be configured to adjust the flow of the working fluid by modulating the power turbine throttle valve 250 to reduce the rotational speed during the overspeed condition.

In other examples, the method provides monitoring and detecting a reduction of pressure of the working fluid in the supercritical state within the working fluid circuit 202 during a process upset. In some examples, the method includes detecting the process upset and subsequently adjusting the flow of the working fluid by modulating the power turbine throttle valve 250 to increase the pressure of the working fluid within the working fluid circuit 202 during a pressure mode control process. A pressure mode controller may be configured to adjust the flow of the working fluid by modulating the power turbine throttle valve 250 to increase the pressure during the process upset.

In other examples, a sliding mode control process may be implemented to protect the power turbine 220, the power generator 240, the shaft 230, or the gearbox 232 from an overspeed condition. The method provides monitoring for a change in the rotational speed of the power turbine 220, the power generator 240, or a shaft 230 coupled between the power turbine 220 and the power generator 240 during the process upset. Upon detecting the increase of rotational speed during the process upset, the method includes adjusting the flow of the working fluid by modulating the power turbine throttle valve 250 to gradually reduce the rotational speed. A sliding mode controller may be configured to adjust the flow of the working fluid by modulating the power turbine throttle valve 250 to gradually reduce the rotational speed and to prevent an overspeed condition. Alternatively, upon detecting a decrease of rotational speed during the process upset, the method includes adjusting the flow of the working fluid by modulating the power turbine throttle valve 250 to gradually increase the rotational speed.

In other examples, the method includes detecting that the power turbine 220, the power generator 240, and/or the shaft 230 is experiencing an overspeed condition and subsequently implementing an overspeed mode control process to immediately reduce the rotational speed. An overspeed mode controller may be configured to adjust the flow of the working fluid by modulating the power turbine throttle valve 250 to reduce the rotational speed during the overspeed condition.

In some embodiments of the heat engine system 200 described herein, the power turbine throttle valve 250 is fluidly coupled to the working fluid circuit 202 and is utilized to control the power turbine 220 for driving the power generator 240. The computer system 206, as part of the control system 204, contains a multi-controller algorithm utilized to control the power turbine throttle valve 250. The multi-controller algorithm has multiple modes to control the power turbine throttle valve 250 for efficiently executing the processes of generating electricity by the heat engine system 200, as described herein. Exemplary modes include precise speed control of the power turbine 220 and the power generator 240 to achieve generator synchronization between the frequencies of the power generator 240 and the electrical grid 244, power control or megawatt control of the heat engine system 200 to achieve maximum desired "load" or power and pressure control in the event of a process upset.

The multi-controller algorithm may be utilized for controlling the power turbine throttle valve 250 with the various desired modes of control by using multiple process variables based on the control mode for managing the working fluid circuit 202 containing at least a portion of the working fluid in a supercritical state (e.g., sc-$CO_2$ advanced cycle). As the system pressure and flowrate within the working fluid circuit 202 is brought to full load (e.g., full power), the power turbine throttle valve 250 may be first modulated to control the rotational speed of the power turbine 220 and the power generator 240 to achieve synchronization with the electrical grid 244. In one or embodiments, a power turbine speed controller, for controlling the power turbine 220 via the power turbine throttle valve 250, utilizes a fine "trim control" provided by a proportional integral derivative (PID) controller in an Allen-Bradley combined generator control module that provides an output in relation to the phase difference of the generator frequency and the "plant bus" or "grid" frequency, for example, the phase difference of the frequency of the power generator 240 and the frequency of the electrical grid 244.

In another embodiment described herein, after achieving synchronization and the generator breaker is closed, the heat engine system 200—and therefore the power turbine throttle valve 250—operates in megawatt mode or power mode. A second controller—the power mode controller—utilizes generator power as a process variable for modulating the power turbine throttle valve 250. The power mode controller utilizes the advance control technique of adaptive tuning to maintain stable megawatt control as the demand for load and/or power is increased. In the event of a process upset and the heat engine system 200 is still connected to the electrical grid 244, a pressure mode controller adjusts the power turbine throttle valve 250 to increase the system pressure during a pressure mode control process. The increased pressure is generally within the high pressure side of the working fluid circuit 202 and helps to gain control or partial control to the working fluid in a supercritical state (e.g., sc-$CO_2$ process).

In another embodiment described herein, a sliding mode control may be implemented to protect the power turbine 220, the gearbox 232, and the power generator 240 from an overspeed condition. In the event that an overspeed is detected, a sliding mode controller will assume control of the power turbine throttle valve 250 to immediately reduce the rotational speed of the turbo machinery, such as the power turbine 220, the shaft 230, and the power generator 240.

It is to be understood that the present disclosure describes several exemplary embodiments for implementing different features, structures, or functions of the invention. Exemplary embodiments of components, arrangements, and configurations are described herein to simplify the present disclosure, however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the present disclosure may include embodiments in which the first and second features are formed in direct contact, and may also include embodiments in which additional features may be formed interposing the first and second features, such that the first and second features may not be in direct contact. Finally, the exemplary embodiments described herein may be combined in any combination of ways, i.e., any element from one exemplary embodiment may be used in any other exemplary embodiment without departing from the scope of the disclosure.

Additionally, certain terms are used throughout the present disclosure and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the present disclosure and in the claims, the terms "including", "containing", and "comprising" are used in an open-ended fashion, and thus should be interpreted to mean "including, but not limited to". All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B", unless otherwise expressly specified herein.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The invention claimed is:

1. A method for generating electricity with a heat engine system, comprising:

circulating a working fluid within a working fluid circuit having a high pressure side and a low pressure side, wherein at least a portion of the working fluid is in a supercritical state;

transferring thermal energy from a heat source stream to the working fluid by a first heat exchanger fluidly coupled to and in thermal communication with the heat source stream and the high pressure side of the working fluid circuit;

transferring the working fluid from the first heat exchanger to a first recuperator fluidly coupled to the high pressure side and the low pressure side of the working fluid circuit, wherein the first recuperator is fluidly coupled to the first heat exchanger within the high pressure side of the working fluid circuit;

transferring thermal energy from the working fluid in the low pressure side to the working fluid in the high pressure side by the first recuperator;

transferring the working fluid from the first recuperator to a second heat exchanger fluidly coupled to and in thermal communication with the heat source stream and the high pressure side of the working fluid circuit;

transferring thermal energy from the heat source stream to the working fluid by the second heat exchanger;

transferring the working fluid from the second heat exchanger to a power turbine;

transferring thermal energy from the working fluid to the power turbine while converting a pressure drop in the working fluid to mechanical energy, wherein the power turbine is disposed between the high pressure side and the low pressure side of the working fluid circuit and fluidly coupled to and in thermal communication with the working fluid;

converting the mechanical energy into electrical energy by a power generator coupled to the power turbine;

transferring the working fluid from the power turbine to the first recuperator;

transferring the working fluid from the first recuperator to a second recuperator fluidly coupled to the high pressure side and the low pressure side of the working fluid circuit;

transferring thermal energy from the working fluid in the low pressure side to the working fluid in the high pressure side by the second recuperator;

transferring the electrical energy from the power generator to a power outlet, wherein the power outlet is electrically coupled to the power generator and configured to transfer the electrical energy from the power generator to an electrical grid;

controlling the power turbine by operating a power turbine throttle valve to adjust a flow of the working fluid, wherein the power turbine throttle valve is fluidly coupled to the working fluid in the supercritical state within the high pressure side of the working fluid circuit upstream from the power turbine; and monitoring and controlling process operation parameters of the heat engine system, wherein monitoring and controlling the process operation parameters comprises:

adjusting the flow of the working fluid by modulating the power turbine throttle valve to control a rotational speed of the power turbine while synchronizing the power generator with an electrical grid; and adjusting the flow of the working fluid by modulating the power turbine throttle valve to adaptively tune the power turbine while maintaining a continuous power output from the power generator.

2. The method of claim 1, wherein the electrical grid contains at least one alternating current bus, alternating current circuit, alternating current grid, or combinations thereof.

3. The method of claim 1, wherein the working fluid comprises carbon dioxide and at least a portion of the carbon dioxide is in a supercritical state.

4. The method of claim 1, wherein a generator control module provides an output signal in relation to a phase difference between a generator frequency of the power generator and a grid frequency of the electrical grid.

5. The method of claim 1, further comprising closing a breaker on the power generator once the power turbine is synchronized with the power generator.

6. The method of claim 1, further comprising:

monitoring the power output from the power generator; and modulating the power turbine throttle valve to adaptively tune the power turbine in response to the power output.

7. The method of claim 1, further comprising monitoring and detecting a reduction of pressure of the working fluid in the supercritical state within the working fluid circuit during a process upset.

8. The method of claim 1, further comprising monitoring and detecting an increase of rotational speed of the power turbine, the power generator, or a shaft coupled between the power turbine and the power generator during a process upset.

9. The method of claim 8, further comprising detecting the increase of rotational speed and subsequently adjusting the flow of the working fluid by modulating the power turbine throttle valve to reduce the rotational speed.

* * * * *